US006659600B2

(12) United States Patent
Oda et al.

(10) Patent No.: US 6,659,600 B2
(45) Date of Patent: Dec. 9, 2003

(54) INKJET RECORDING HEAD CARTRIDGE AND INKJET RECORDING APPARATUS

(75) Inventors: Kazuyuki Oda, Ebina (JP); Koji Ikegami, Ebina (JP); Tomoki Umezawa, Ebina (JP); Ichiro Tomikawa, Ebina (JP); Masaki Kataoka, Ebina (JP); Kenji Yamazaki, Ebina (JP); Norikuni Funatsu, Ebina (JP); Yoshihisa Ueda, Ebina (JP); Kohzo Hara, Ebina (JP); Takayuki Takeuchi, Ebina (JP); Kunihito Satou, Ebina (JP); Toshinobu Hamazaki, Ebina (JP); Koichi Saitoh, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 209 days.

(21) Appl. No.: 09/862,319

(22) Filed: May 23, 2001

(65) Prior Publication Data

US 2002/0027585 A1 Mar. 7, 2002

(30) Foreign Application Priority Data

Jul. 24, 2000 (JP) ..... 2000-223037

(51) Int. Cl.[7] ..... B41J 2/19
(52) U.S. Cl. ..... 347/92
(58) Field of Search ..... 347/87, 86, 92, 347/61, 70

(56) References Cited

U.S. PATENT DOCUMENTS 5,105,209 A * 4/1992 Koto et al. ..... 347/70
6,116,726 A * 9/2000 Driggers ..... 347/87

FOREIGN PATENT DOCUMENTS

| | | | |
|---|---|---|---|
| JP | 54160241 A | * 12/1979 | ..... 347/92 |
| JP | 55-128465 | 10/1980 | |
| JP | 5-31904 | 2/1993 | |
| JP | 6-218945 | 8/1994 | |
| JP | 7-125234 | 5/1995 | |
| JP | 9-131890 | 5/1997 | |
| JP | 9-136415 | 5/1997 | |
| JP | 9-226142 | 9/1997 | |
| JP | 9-277552 | 10/1997 | |

* cited by examiner

*Primary Examiner*—Anh T. N. Vo
(74) *Attorney, Agent, or Firm*—Morgan Lewis & Bockius LLP

(57) ABSTRACT

The present invention provides an inkjet recording head cartridge and an inkjet recording apparatus that have a simple structure and high reliability. Since individual flow passages in which ink emission orifices are formed are communicated directly with a rectangular ink supply chamber, it is prevented that a bubble of such a size as to cause printing defects rises through an ink supply chamber and blocks the individual flow passages. Also, since ink heated within the ink supply chamber is moved upward to the ink tank chamber by convection and grows an air lump sealed beforehand, it is prevented that a bubble will grow in the ink supply chamber. Furthermore, by allocating a large cross-sectional area to the ink supply chamber, it is prevented that meniscus oscillation of the ink emission orifices is amplified by pressure oscillation caused by ink emission and causes a printing defect. Therefore, reliable printing can be performed with a simple construction.

14 Claims, 15 Drawing Sheets

INKJET RECORDING HEAD CARTRIDGE AND INKJET RECORDING APPARATUS

BACKGROUND OF THE INVENTION

1. Field of the Invention

The present invention relates to an inkjet recording head cartridge and an inkjet recording apparatus.

2. Description of the Prior Art

An inkjet recording head cartridge (hereinafter referred to as cartridge) mounted in the carriage of conventional inkjet recording apparatuses is constructed to supply ink to a supply orifice of a head (head chip) through an ink supply passage from an ink tank.

The cartridge thus constructed has problems in (1) processing for bubbles generated in the ink supply passage and the head and (2) control of the fluctuation of ink supply pressure within the ink supply passage and the head. Various proposals are made to solve these problems. Hereinafter, a description will be made of several of these proposals.

The following four examples are proposed as measures against (1).

According to the invention disclosed in Japanese Published Unexamined Patent Application No. Hei 6-218945 (hereinafter referred to as conventional example 1), upon detecting bubbles generated in an ink supply passage, recording operation is stopped to prevent the bubbles from invading into a recording head.

Also, according to the invention disclosed in Japanese Published Unexamined Patent Application No. Hei 9-226142 (hereinafter referred to as a conventional example 2), an ink supply passage having a smaller cross-sectional area than that of a recording head opening part is provided to increase an ink flow velocity and thereby increase the ability to eliminate bubbles.

Furthermore, according to the invention disclosed in Japanese Published Unexamined Patent Application No. Hei 9-277552 (hereinafter referred to as a conventional example 3), a filter provided in an ink flow passage is provided with a bubble discharge part which discharges bubbles by pressuring the ink flow passage toward the outside.

According to the invention disclosed in Japanese Published Unexamined Patent Application No. Hei 9-131890 (hereinafter referred to as a conventional example 4), a wall outlined along a manifold is provided to discharge bubbles upward without depositing them on the wall face.

On the other hand, the following four example are proposed as measures against (2).

According to the invention disclosed in Japanese Published Unexamined Patent Application No. Hei 5-31904 (hereinafter referred to as a conventional example 5), bubbles are formed within a common liquid chamber by heating, and pressure waves are absorbed by transforming the bubbles to restrain pressure fluctuation caused by ink injection.

Also, according to the invention disclosed in Japanese Published Unexamined Patent Application No. Sho 55-128465 (hereinafter referred to as a conventional example 6), a minute hole for communication between the ink liquid passage and air is provided in part of the ink liquid passage to restrain pressure fluctuation.

Furthermore, according to the invention disclosed in Japanese Published Unexamined Patent Application No. Hei 7-125234 (hereinafter referred to as a conventional example 7), a gas holding part and a subheater for changing the volume of gas are provided to restrain pressure fluctuation caused by ink injection by changing the natural frequency of an ink supply system.

Furthermore, according to the invention disclosed in Japanese Published Unexamined Patent Application No. Hei 9-136415 (hereinafter referred to as a conventional example 8), plural gas holding parts for holding gas therein are provided in an ink supply passage to absorb pressure oscillation.

There are the following problems in the conventional examples 1 to 4.

In the conventional example 1, a bubble detection unit is required and it is questionable whether satisfactory bubble detection precision is obtained. Also, if a bubble is detected, recording must be temporarily halted.

In the conventional example 2, although it is possible to decrease the frequency of bubble-induced printing defects to some degree, it is impossible to completely eliminate printing defects.

In the conventional example 3, a pressurizing system for discharging bubbles is required, so that the apparatus becomes complicated.

In the conventional example 4, discharged bubbles accumulate under a filter and, if the accumulated bubbles spread throughout the manifold, printing would be disabled.

There are the following problems in the conventional examples 5 to 8.

In the conventional example 5, a heating unit in addition to an emission heater is required in the common liquid chamber, so that the mechanism becomes very complicated. Also, it is very difficult to control the size of bubbles generated by the heating unit.

In the conventional example 6, ink evaporation from the minute hole for communication with air and ink hardening in the minute hole are problematic.

In the conventional example 7, a heating unit is additionally required, so that the mechanism becomes complicated. Also, bubble size control is difficult.

In the conventional example 8, gas holding parts must be created, and therefore the construction of the ink supply passage becomes complicated. Also, gas in the gas holding parts may replace ink in the course of long-term preservation.

As described above, the conventional examples 1 to 8 have the problems that the structure of the mechanism is complicated or conventional problems cannot be completely solved.

SUMMARY OF THE INVENTION

Therefore, the present invention provides an inkjet recording head cartridge and an inkjet recording apparatus that have a simple structure and high reliability.

According to an aspect of the present invention, the inkjet recording head cartridge includes individual flow passages each having an ink emission orifice at one end thereof and an ink inflow orifice at another end thereof, an ink supply chamber communicating with the ink inflow orifices, and a heater face provided to be orthogonal to an ink emission face on which the ink emission orifices are formed, the heater face being part of the side of the ink supply chamber formed within an ink supplier. The ink supply chamber is formed to have a cross-sectional area allocated in an ink flow direction so that buoyancy acting on a bubble occurring in the ink supply chamber the size of which would cause a printing defect becomes larger than drag based on an ink flow velocity in the ink supply chamber when ink is emitted from all the ink emission orifices acting on the bubble, whereby the bubble moves away from the ink inflow orifices.

A bubble that occurring in the ink supply chamber due to printing operation or the like grows because of printing operation or the like and may hinder ink supply as a result of blocking the ink inflow orifices of the individual flow passages, causing a printing defect. In the present invention, the buoyancy that moves a bubble growing to such a size as to cause a printing defect away from the individual flow passages acts larger than drag based on the flow velocity of ink that flows toward the individual flow passages from the ink supply chamber. As a result, a bubble large enough to cause a printing defect is moved away from the individual flow passages (the ink inflow orifices) by the buoyancy, so that stable printing is achieved. Therefore, an ink suck mechanism or the like need not be used to discharge bubbles by sucking ink. In other words, highly reliable printing can be performed by preventing bubble-induced printing defects with a simple structure.

According to another aspect of the present invention, the following two expressions are satisfied for a given printing rate.

$$[(Q/S)^2 \times Cd \times \rho \times \pi \times d^2]/8 < (\rho \times g \times \pi \times d^3)/6;$$

and $$d \geqq 2Np$$

where

Q: Average ink flow quantity during printing,

S: Minimum cross-sectional area in the ink flow direction within the ink supply chamber, Cd: Resistance coefficient, ρ: Ink density, g: Gravitational constant, Np: Individual flow passage (ink emission orifice) pitch, and D: Bubble diameter.

A bubble within the ink supply chamber that has at least twice (=2Np) the diameter of individual flow passage pitch is difficult to discharge from one individual flow passage by ink emission. As a result, the individual flow passage remains blocked, causing a printing defect. Therefore, by having the ink supplier and the head chip so that buoyancy $[(\rho \times g \times \pi \times d^3)/6]$ acting on the bubble ($d \geqq 2Np$) is greater than drag $[[(Q/S)^{2 \times Cd \times \rho \times \pi \times d2}]/8]$ produced by the flow velocity of ink that flows into the individual flow passage from the ink supply chamber, the bubble to cause the printing defect is moved away from the individual flow passage by the buoyancy. Therefore, bubble-induced printing defects can be prevented with a simple structure without having to provide a mechanism for discharging bubbles.

According to another aspect of the present invention, the ink supply chamber includes an ink tank part that communicates with the ink supply chamber and supplies ink to the ink supply chamber.

Since the ink tank part that supplies ink to the ink supply chamber is provided, an ink exchange interval is extended by supplying ink to the ink supply chamber from the ink tank part, improving the ease of use of the inkjet recording head cartridge.

According to another aspect of the present invention, a filter member intervenes between the ink supply chamber and the ink tank part.

Since a filter is provided between the ink supply chamber and the ink tank part, it can impede invasion into the head chip of foreign particles coming through the ink supply chamber from the ink tank part, increasing the reliability of printing. In other words, printing can be performed with high image quality. Moreover, since the filter member is provided, by exchanging only the ink tank part, the head can be used up to its operating life without discarding it at ink exchange.

According to another aspect of the present invention, the ink tank part is located upward in the gravity direction with respect to the ink supply chamber and holds ink in free condition.

Ink within the ink supply chamber is heated by printing operation and causes convection. Therefore, if the ink tank part is holding the ink in free condition, bubbles within the ink supply chamber are moved to the ink tank part by the convection, preventing the bubbles from growing in the ink supply chamber. As a result, the possibility that the bubbles cause a printing defect can be reduced.

According to another aspect of the present invention, an air lump of 1 $mm^3$ or more always exists in the ink tank part.

By sealing beforehand an air lump of 1 $mm^3$ or more in the ink tank part, bubbles occurring in the ink supply chamber are moved to the ink tank part by convection and grow integrally with the air lump within the ink tank part. In other words, it can be prevented that bubbles growing in the ink supply chamber impede ink supply from the ink tank part to the ink supply chamber.

According to another aspect of the present invention, the recording head cartridge is shipped with ink filled without bubbles existing in the ink supply chamber.

The recording head cartridge is shipped with ink filled without bubbles existing in the ink supply chamber. If a bubble exists in the ink supply chamber, when gas is deposited from the ink by printing operation or the like, the bubble already existing in the ink supply chamber grows mainly and impedes ink supply from the ink tank part to the ink supply chamber, possibly causing a printing defect. Accordingly, by shipping the recording head cartridge without bubbles existing in the ink supply chamber, bubble growth within the ink supply chamber is restrained and the above-described printing defect is prevented.

According to another aspect of the present invention, the sum of the capacity of the ink supply chamber and the initial capacity of ink in free condition in the ink tank part is greater than the total volume of ink emitted during one print job, defined in an ink temperature rise and cooling cycle in the recording head cartridge.

Ink temperature within the ink supply chamber rises because of printing operation and ink is moved to the ink tank part by convection, generating and growing a bubble. However, also in the ink supply chamber, air dissolved in the ink deposits as a bubble. Usually, the bubble dissolves in the ink again when the ink temperature has fallen after the termination of the print job. However, if printing operation is performed continuously, the bubble grows and no longer dissolves in the ink even if the ink has been cooled.

Data obtained experimentally shows that if the sum of the capacity of the ink supply chamber and the initial capacity of ink held in free condition in the ink tank part is greater than the total volume of ink emitted during one print job, air deposited by a rise in ink temperature dissolves in the ink again when the ink temperature has fallen. Therefore, the bubble generation and bubble growth in the ink supply chamber, caused by printing operation, can be restrained without fail.

According to another aspect of the present invention, the inkjet recording head cartridge includes an ink emission face on which ink emission orifices are formed, an ink supplier provided with an ink supplying chamber inside thereof; and a heater face orthogonal to the ink emission face, the heater face being part of the side of the ink supply chamber. The ink supply chamber is formed so as to have a cross-sectional area allocated in an ink flow direction so that pressure fluctuation within the ink supply chamber at the time of ink emission becomes an overattenuation mode or critical attenuation mode.

Since the ink supply chamber is formed so as to have a cross-sectional area in an ink flow direction so that pressure fluctuation within the ink supply chamber at the time of ink emission becomes an overattenuation mode or critical attenuation mode and, regardless of printing condition, it can be prevented without fail that the pressure fluctuation amplifies so that the ink refill of the ink emission orifices become imperfect, causing ink emission defects.

According to another aspect of the present invention, the inkjet recording head cartridge includes an ink emission face on which ink emission orifices are formed, an ink supplier provided with an ink supplying chamber inside thereof, and a heater face orthogonal to the ink emission face, the heater face being part of the side of the ink supply chamber. The relation of $(R1+R2)^2\times(C1+C2)\geqq 4\times(L1+L2)$ is satisfied, where L1 is the inertance of the individual flow passage, L2 is the inertance of the ink supply chamber, R1 is the resistance value of the individual flow passage, R2 is the resistance value of the ink supply chamber, C1 is the capacitance of meniscus of the ink emission orifice, and C2 is the capacitance of the ink supply chamber.

Since the present invention forms the ink supplier and the head chip so that the above-described relational expression is satisfied, for patterns of any image quality, pressure oscillation at the time of ink emission can be completely attenuated. Therefore, by appropriately designing the internal volume, cross-sectional area, and length of the ink supply chamber of the present invention, pressure fluctuation within the ink supply chamber at the time of ink emission can be attenuated without causing a bubble or communicating with the outside air, thereby providing increased printing reliability.

According to another aspect of the present invention, an ink jet recording apparatus including any of the above inkjet recording head cartridges is provided.

By mounting the inkjet recording head cartridge, without providing a special mechanism, bubble-induced printing defects, and printing defects caused by the resonance of pressure fluctuation within the ink supply chamber can be prevented. As a result, a reliable inkjet recording apparatus with a simple structure can be provided.

According to another aspect of the present invention, the inkjet recording apparatus includes: individual flow passages having each an ink emission orifice at one end thereof and an ink inflow orifice at another end; an ink supply chamber having open ink inflow orifices; an inkjet recording head cartridge having an ink tank part that supplies ink to the ink supply chamber through a filter member placed upward in the gravity direction of the ink supply chamber; a determination unit that determines whether, in one print job defined in temperature rise and cooling cycles of ink in the recording head cartridge, the total volume of ink emitted from the ink emission orifices exceeds the sum of the capacity of the ink supply chamber and the initial capacity of ink held in free condition in the ink tank part; and a printing control unit that, if the total volume of the ink exceeds the sum, halts printing during the print job, and resumes printing after the ink within the ink supply chamber is cooled to a predetermined temperature.

The ink temperature of the ink supply chamber rises because of printing operation and the ink is moved to the ink tank part by convection, generating and growing a bubble. However, also in the ink supply chamber, air dissolved in the ink deposits as a bubble. Usually, the bubble within the ink supply chamber dissolves in the ink again when the ink temperature has fallen after the termination of the print job. However, if printing operation is performed continuously, the bubble grows and does not dissolve again in the ink even if the ink has been cooled.

Accordingly, in the present invention, in the case where a determination unit determines that the total amount of emitted ink used by printing exceeds the sum of the capacity of the ink supply chamber and the initial capacity of ink held in free condition in the ink tank part, printing operation is temporarily halted to cool the ink, thereby preventing the bubble from growing to the extent that it cannot redissolve. This prevents printing defects caused by the growth of the bubble from reducing image quality.

BRIEF DESCRIPTION OF THE DRAWINGS

Preferred embodiments of the present invention will be described in detail based on the followings, wherein.

DESCRIPTION OF THE PREFERRED EMBODIMENTS

An inkjet recording apparatus and an inkjet recording head cartridge according to an embodiment of the present invention will be described with reference to FIGS. 1 to 16.

Figure 2:
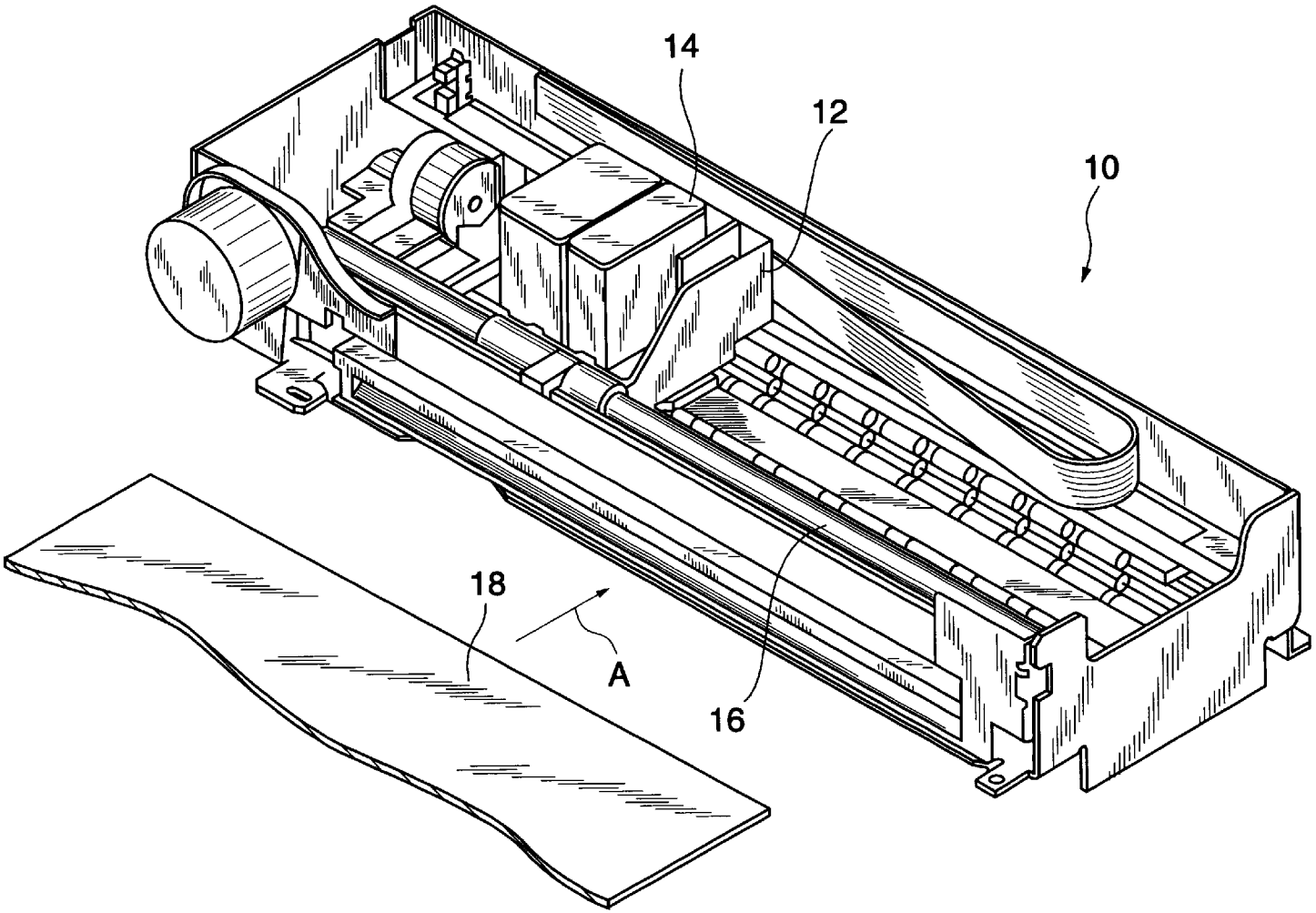
FIG. 2 is a schematic view of an inkjet recording apparatus according to one embodiment of the present invention.

An inkjet recording apparatus 10, as shown in FIG. 2, is constructed so that an inkjet recording head cartridge (hereinafter referred to as cartridge) 14 held in a carriage 12 is scanned along a guide shaft 16 to perform printing on paper 18 carried in the direction of the arrow A.

Figure 1:
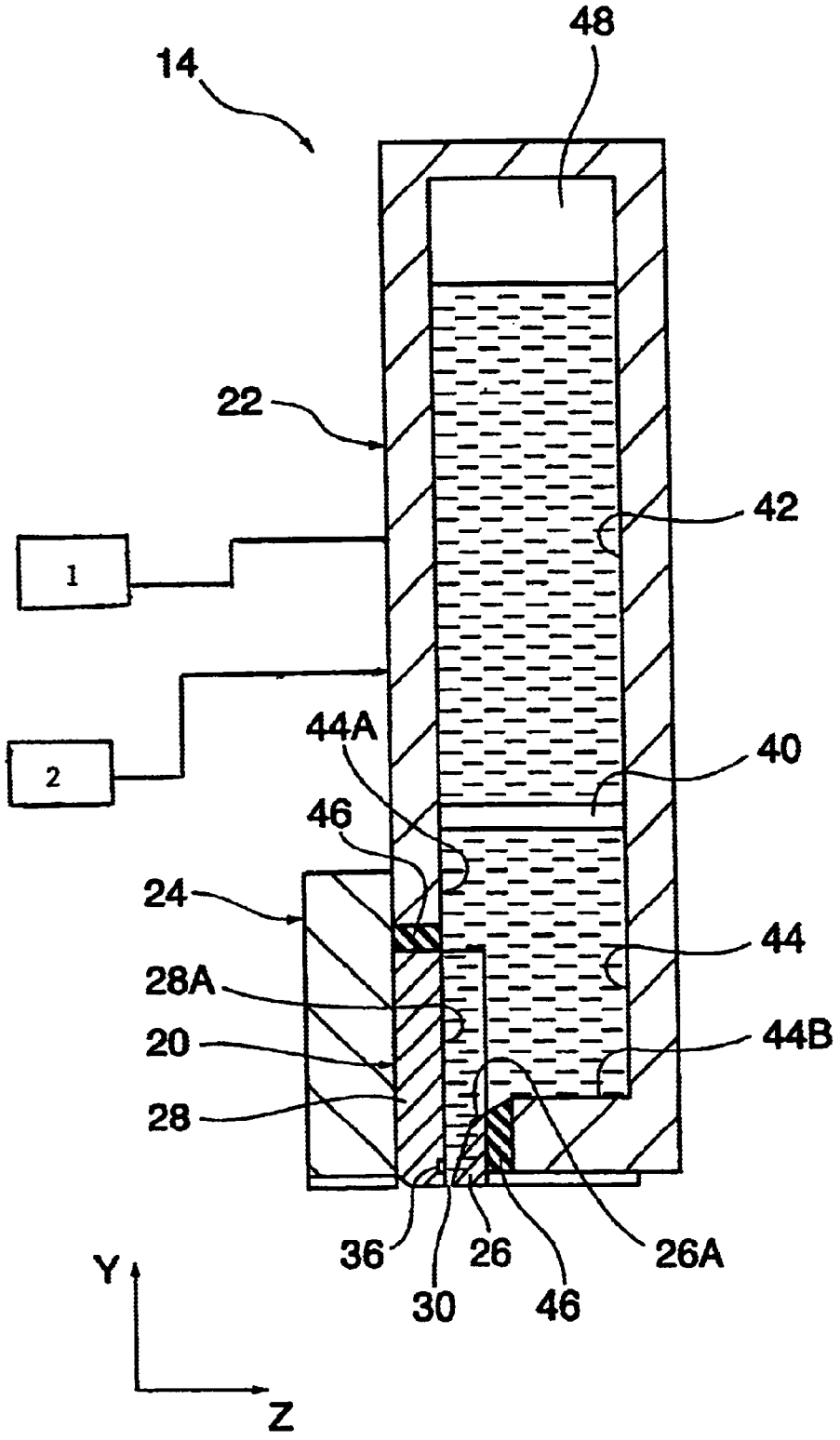
FIG. 1 is a longitudinal sectional view of an inkjet recording head cartridge according to one embodiment of the present invention.

A cartridge 14, as shown in FIG. 1, basically includes a head chip 20 in which ink emission orifices 30 described later and other components are formed; an ink supplier 22 that supplies ink to the head chip 20; and a heat sink 24 that maintains the heat radiation capability of the head chip 20.

Figure 3A:
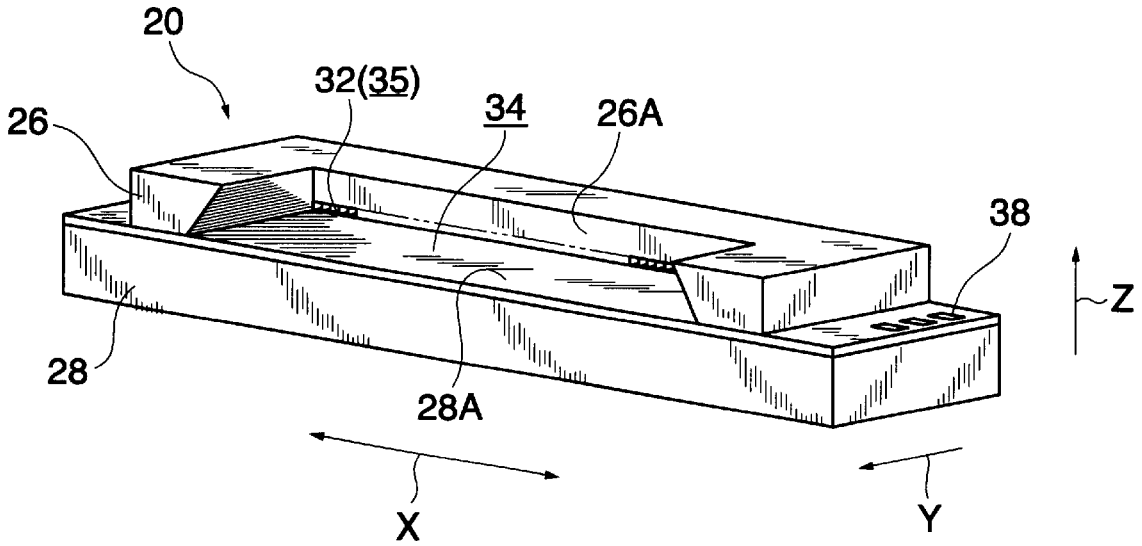
FIG. 3A is a front perspective view of a head chip according to one embodiment of the present invention.
Figure 3B:
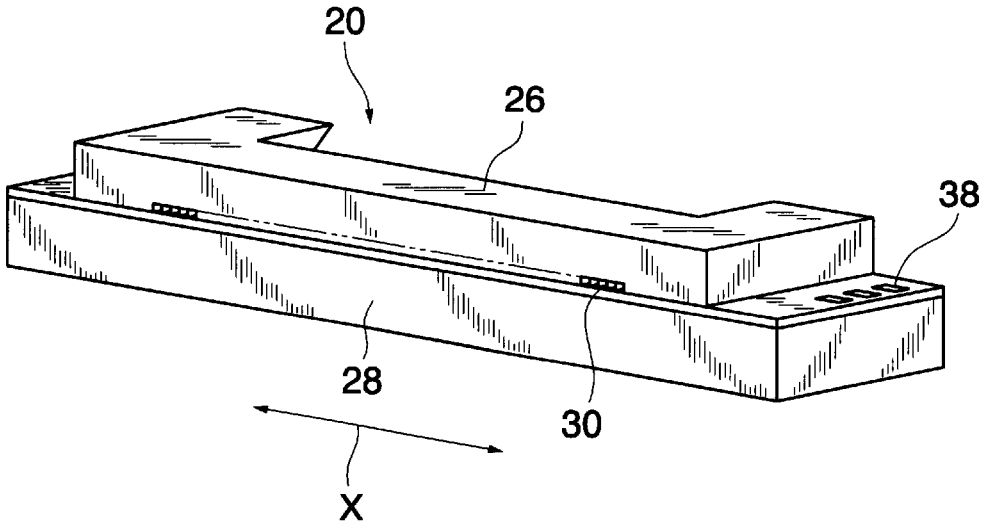
FIG. 3B is a back perspective view of the same.

As shown in FIGS. 3A and 3B, the head chip 20, formed by a heat-generating substrate 26 and a flow passage substrate 28 being joined with each other, basically includes: plural ink emission orifices 30 formed on an end face (ink emission face) thereof; individual flow passages 32 that communicate with the ink emission orifices 30; a common liquid chamber 34 that communicates with all the individual flow passages 32 and extends in a nozzle array direction; and a heat generating element 36 (see FIG. 1) that is disposed in facing relation with the individual flow passage 32.

The common liquid chamber 34 opens in the direction (the direction of arrow Y) in which the individual flow passages 32 extend and the direction (the direction of arrow Z) orthogonal to the individual flow passages 32 (hereinafter, the opening may be called an ink inflow orifice 35).

An electrical signal input/output terminal 38 is provided at both ends of the head chip 12 in the X direction.

The ink supplier 22 has the construction in which an opening is formed at one corner of the lower end of a housing of almost rectangular parallelepiped wherein the head chip 20 is attached to the opening through an elastic seal member 46. The head chip 20 is integrated with the ink supplier 22, whereby an ink tank chamber 42 and an ink supply chamber 44, which are two parts of almost rectangular parallelepiped, divided by a filter 40, are formed within the ink supplier 22.

In other words, the side (the heater face) 28A of the heat generating element substrate 28 that constitutes the common liquid chamber 34 of the head chip 20 servers as a part of the wall face 44A of the gravity direction of the ink supply chamber 44 and the upper face 26A of the flow passage substrate 26 serves as a part of the wall face 44B of the ink supply chamber 42 orthogonal to the individual flow passages 32.

Therefore, the common liquid chamber 28 serves as a part of the ink supply chamber 44 and the ink inflow orifices 35 of the individual flow passages 32 open directly to the ink supply chamber 44. The ink supply chamber 44 is continuous in the direction (upward in the gravity direction) in which the individual flow passages 32 extend, and has a large cross-sectional area allocated in a direction (horizontal direction) orthogonal to the direction in which the individual flow passages 32 extend.

The ink supply chamber 44 is filled with ink so that no bubble exists in an initial state. Also, an air lump 48 of 1 $mm^3$ or more is introduced into the ink tank chamber in an initial state to grow a bubble in the ink tank chamber 42.

To the ink tank chamber 42, ink can be supplied from an external main ink tank and a secondary ink tank that can be freely mounted in and dismounted from the upper part of the cartridge 14 (a drawing is omitted).

In terms of bubble control described later, it is necessary that the cartridge 14 has at least the ink tank chamber 42, the ink supply chamber 44, and the ink emission orifices 30 (individual flow passages 32) placed in that order downward in the gravity direction.

A control unit not shown monitors the ink temperature and the total amount of emitted ink in the ink supply chamber 44, halts temporarily printing operation if the total amount of emitted ink exceeds a predetermined quantity, waits until the ink temperature falls to a predetermined temperature, and then continues printing operation.

(Effect of the Present Embodiment)

A description will be made of the effect of the inkjet recording apparatus 10 (cartridge 14) thus constructed. There are three major points as the effect of the inkjet recording apparatus 10 (cartridge 14) of the present embodiment. Hereinafter, the three points will be described through comparison with a comparative example.

(Comparative Example)

Figure 4:
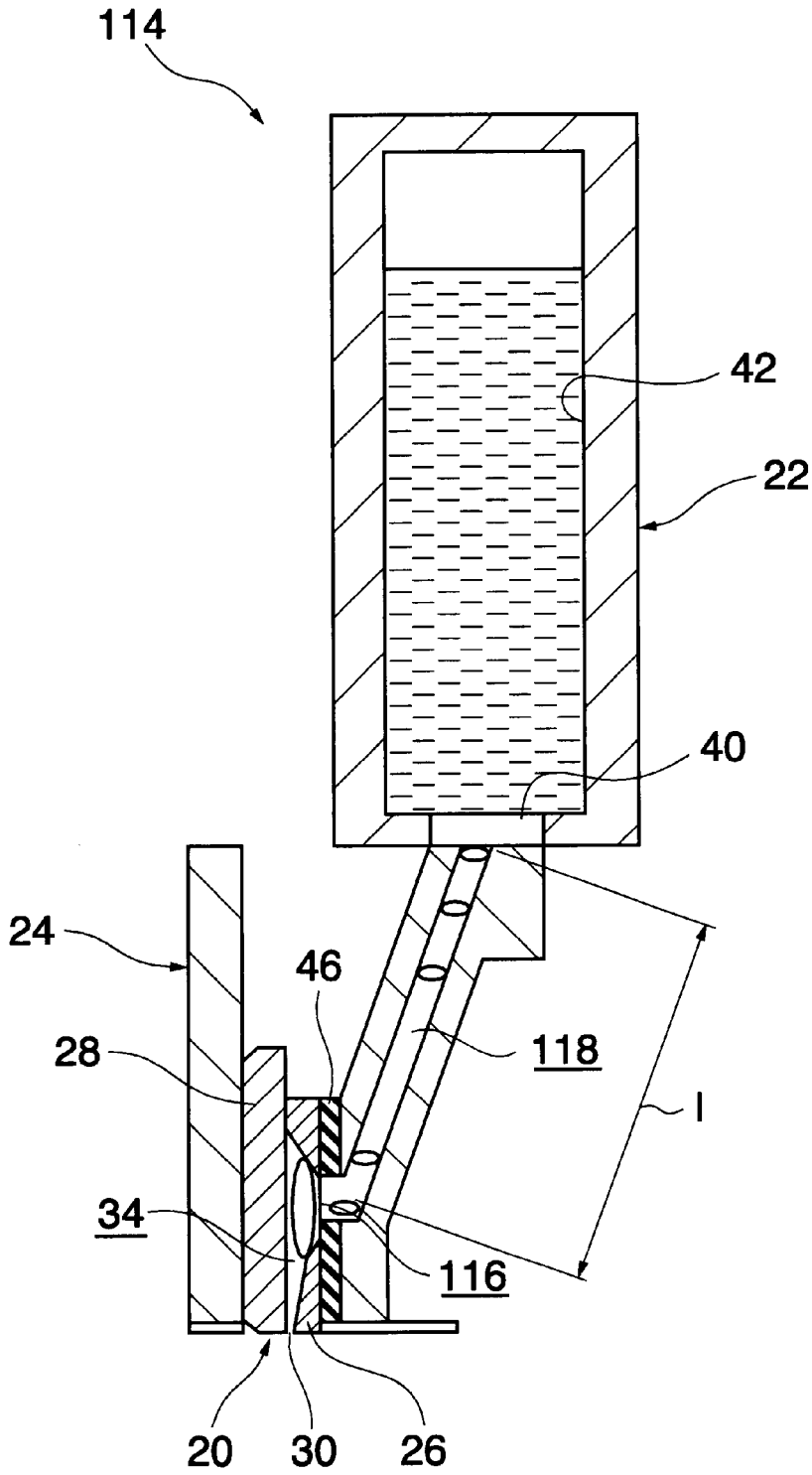
FIG. 4 is a longitudinal sectional view of the inkjet recording head cartridge according to a comparative example.

First, a cartridge of a comparative example will be described with reference to FIG. 4. Components shown in FIG. 4 that are almost identical to components shown in the present embodiment are identified by the same reference numerals, and detailed descriptions of them are omitted.

In a cartridge 114 of the comparative example, an ink supply orifice 116 formed in a common liquid chamber 34 of a head chip 20 and, an ink tank chamber 42 of an ink supplier 22 are communicated with each other by an ink pipeline 118 (equivalent to the ink supply chamber 44 of the present embodiment).

(First Effect)

The first effect of cartridge 14 is that a printing defect (hereinafter referred to as a bubble printing defect) caused when a bubble blocks the individual flow passages 32 can be satisfactorily prevented without having to perform maintenance.

Generally, a bubble-induced printing defect occurs when a large bubble flows into the head chip 20 and, as a result, ink supply to the ink emission orifices 30 (individual flow passages 32) is impeded.

Bubble-induced printing defects include those that are recovered when a bubble concerned is discharged from the ink emission orifices 30 by emitted ink, and those that are not recovered because the bubble is not discharged by emitted ink alone. Bubble-induced printing defects not recovered by emitted ink alone are particularly problematic. To recover the printing defects, the negative pressure maintenance is performed which brings a cap member into contact with the nozzle face of a head and applies negative pressure with a negative pressure pump to suck the bubble along with ink.

However, the negative pressure maintenance has the following two problems: first, since it requires a negative pressure pump, the maintenance apparatus is complicated with increased costs, and secondary, sucked ink becomes useless and wasted ink increases, so that the capacity of a tank for the wasted ink must be increased.

Accordingly, the inventor of the present invention proposes the following. That is, a cartridge is constructed so as to move a bubble to cause a printing defect away from the end of the individual flow passages 32 by means of buoyancy by blocking the end of the individual flow passages 32 so that a printing defect can be prevented without performing the negative pressure maintenance.

The cartridge 14 shown in FIG. 1 (hereinafter referred to as an embodiment example) functions as described below when buoyancy and drag acting on a bubble in the ink supply chamber 44 are taken into account.

Letting a minimum cross-sectional area of the ink supply chamber in ink flow direction be S; average ink flow quantity during printing be Q; ink density be ρ; gravity constants be g; resistance coefficient be Cd; emission orifice (individual flow passage) pitch be Np; and bubble diameter be d, drag acting on a bubble is represented by $$F1=[(Q/S)^2\times Cd\times\rho\times\pi\times d^2]/8 \quad (1)$$

Also, buoyancy F2 acting on a bubble is represented by $$F2=(\rho\times g\times\pi\times d^3)/6 \quad (2)$$

Therefore, if buoyancy F2 acting on a bubble becomes greater than drag F1 caused by ink flow (F2>F1), in other words, if the following expression $$(\rho\times g\times\pi\times d3)/6>[(Q/S)2\times Cd\times\rho\times\pi\times d2]/8 \quad (3)$$

is satisfied, the bubble is moved up by buoyancy upward in vertical direction (in the present embodiment, in the direction from the individual flow passages 32 of the head to the filter 40).

When Reynolds number Re<1, resistance coefficient Cd satisfies Cd=24/Re, and when ink viscosity is $\mu$ and ink flow velocity is v, because Reynolds number Re is represented as Re=ρ×v×d/$\mu$, the expression (1) is arranged into $$F1=3\times\pi\times\mu\times v\times d \quad (4)$$

When the expression (4) is substituted into the expression (3) and the result is arranged by with respect to d, the following expression is obtained.

$$d>[18\times\mu\times v)/(\rho\times g)]^{1/2} \quad (5)$$

This bubble diameter d indicates a bubble diameter at the time when buoyancy F2 becomes larger than the drag F1 of ink flow. Therefore, bubbles equal to or smaller than this diameter are made to flow in a head (individual flow passages 32) direction together with ink during printing.

In contrast, it is demonstrated from the result of observation that the bubble size to cause bubble-induced printing defects not recovered by ink emission alone is equal to or greater than a bubble size that causes plural individual flow passages 32 (ink inflow orifices 35) to be blocked. This indicates that, although bubbles of such a size as to block one individual flow passage 32 can be discharged from the ink emission orifices 30 by a pressure at the time of ink emission, bubbles of such a size as to block adjacent individual flow passages 32 also are difficult to discharge from the individual flow passages 32 (ink emission orifices 30) by transforming the bubbles by only the pressure at the time of ink emission. Therefore, when the pitch of the individual flow passages 32 is Np, a bubble diameter d to cause printing defects is represented as $$d\geqq 2Np \quad (6)$$

Therefore, by creating the cartridge 14 so that the expressions (3) and (6) are satisfied, the cartridge 14 is freed from maintenance.

Referring to a comparative example, a detailed description will be made of how the cartridge 14 is constructed to achieve the above-described effect.

In a comparative example (see FIG. 4), the common liquid chamber 34 to which one end of the individual flow passages 32 is open, and the ink tank chamber 42 are connected by an ink pipeline 118 having a small cross-sectional area. Therefore, an ink flow velocity ((Q/S) in the expression (3)) of the ink pipeline 118 becomes high, so that bubbles (d≧2Np) to cause bubble defects cannot always rise. Therefore, if negative pressure maintenance is not performed, the bubbles may grow in the common liquid chamber 34, causing printing defects.

On the other hand, in this enforcement example, a flow passage that connects the ink supply chamber 44 and the individual flow passages 32 is defined by a rectangular ink supply chamber 42 having a large cross-sectional area S. In other words, since the individual flow passages 32 are directly open to the large-capacity ink supply chamber 44 (the common liquid chamber 34 is a part of the ink supply chamber 44), an ink flow velocity (Q/S) at the time of ink emission is lower than that of the comparative example, decreasing drag F1 acting on bubbles. As a result, bubbles (d≧2Np) of such a size as to cause printing defects can satisfy the expression (3). In other words, bubbles of such a size as to cause printing defects are made to rise without fail by buoyancy F2 and deposit from the ink inflow orifice 35 located downward in the gravity direction within the ink supply chamber 44. Therefore, without performing negative pressure maintenance, bubble-induced printing defects occurring when the ink inflow orifices 35 (individual flow passages 32) are blocked by bubbles can be prevented without fail.

(Test)

To confirm the aforementioned effect, printing operation was actually performed for the embodiment example and the comparative example to determine how many sheets had been printed until a bubble-induced printing defect occurred.

The printing specification of a head of a test example (the embodiment example, the comparative example) has a resolution of 800 dpi and 512 ink emission orifices (individual flow passages), and has a printing frequency of 20 kHz, a drop quantity of 5 pl, and a print speed of 5 ppm (sheet/minute) for A4-size paper. In this case, an average ink flow quantity Q during printing satisfies the relation of 0<Q≦(ink flow quantity for printing rate 100%). In the test example, an ink flow quantity (maximum ink flow quantity) for printing rate 100% is estimated as 26 $mm^3$/sec.

The cross-sectional area S of the ink supply chamber 44 in a flow direction in the embodiment example is 300 $mm^2$, which is 300 or more times the cross-sectional area S(=0.8 $mm^2$) of the ink pipeline line 118 of the comparative example (corresponding to the ink supply chamber 44 of the embodiment example).

Ink used in the test example had an ink viscosity $\mu$ of 2.01 Pa.sec and an ink density ρ of 1050 kg/$mm^3$. Also, an image used for printing evaluation had a printing rate 5 to 100%.

Test results are shown in Table 1.

TABLE 1

| | EMBODIMENT EXAMPLE | COMPARISON EXAMPLE |
|---|---|---|
| AVERAGE NUMBER OF SHEETS HAVING BEEN PRINTED UNTIL A BUBBLE-INDUCED IMAGE QUALITY DEFECT OCCURRED (WITH COVERAGE OF 5%) | NO IMAGE QUALITY DEFECT NOT OBSERVED AFTER THE PRINTOUT OF 30,000 SHEETS (TRUNCATED DATA) | 300 SHEETS |

In this way, the embodiment example caused no bubble-induced printing defect even after the printout of 30,000 sheets for the estimated life 10,000 sheets of head cartridge. In other words, it was confirmed that negative pressure maintenance for recovery was unnecessary.

In contrast, the comparative example causes a printing defect for printing of about 300 sheets and requires negative pressure maintenance each time the printing defect occurs.

To confirm this effect, values are assigned to the expression (5). For example, if a printing rate is 100%, an ink flow velocity in the ink supply chamber of the embodiment example is 0.087 mm/sec because of $v=Q/S=26(mm^3/sec)/300(mm^2)=0.087$ mm/sec, and an ink flow velocity in the ink pipeline of the comparative example is 33 mm/sec because of $v=Q/S=26(mm^3/sec)/0.8(mm^2)=33$ mm/sec. Similarly, by finding an ink flow velocity in a printing rate and assigning the value to the expression (5), the relationship between the diameter of bubble flowing into the head and, ink flow velocity was obtained (see FIG. 5).

When $1<Re<100$, the expression (5) was compensated for by $Cd=24/Re\times(1\times0.15\times Re^{0.687})$.

Figure 5:
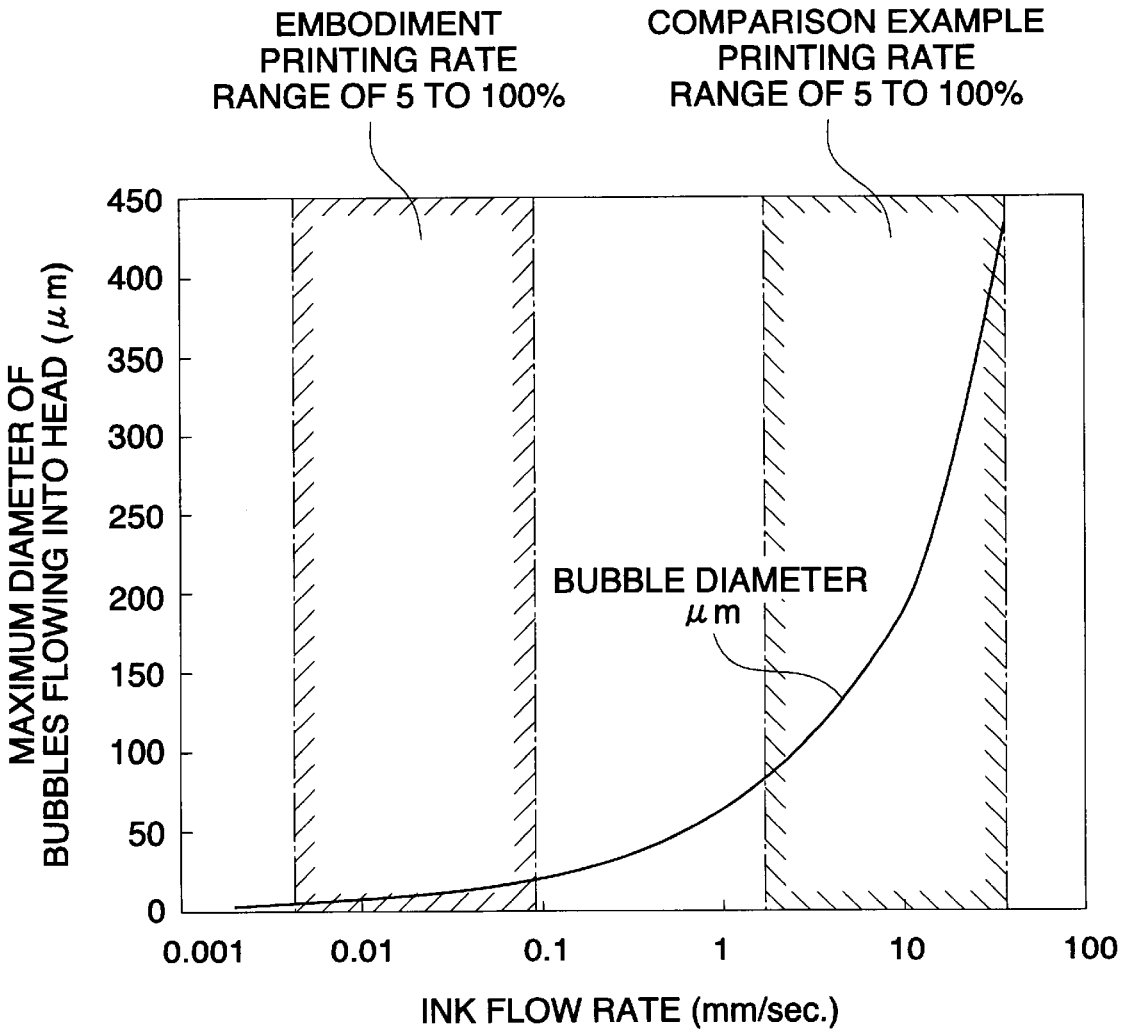
FIG. 5 is a graph showing the relationship between ink flow velocity and the maximum diameter of bubbles flowing to the head.
Figure 6:
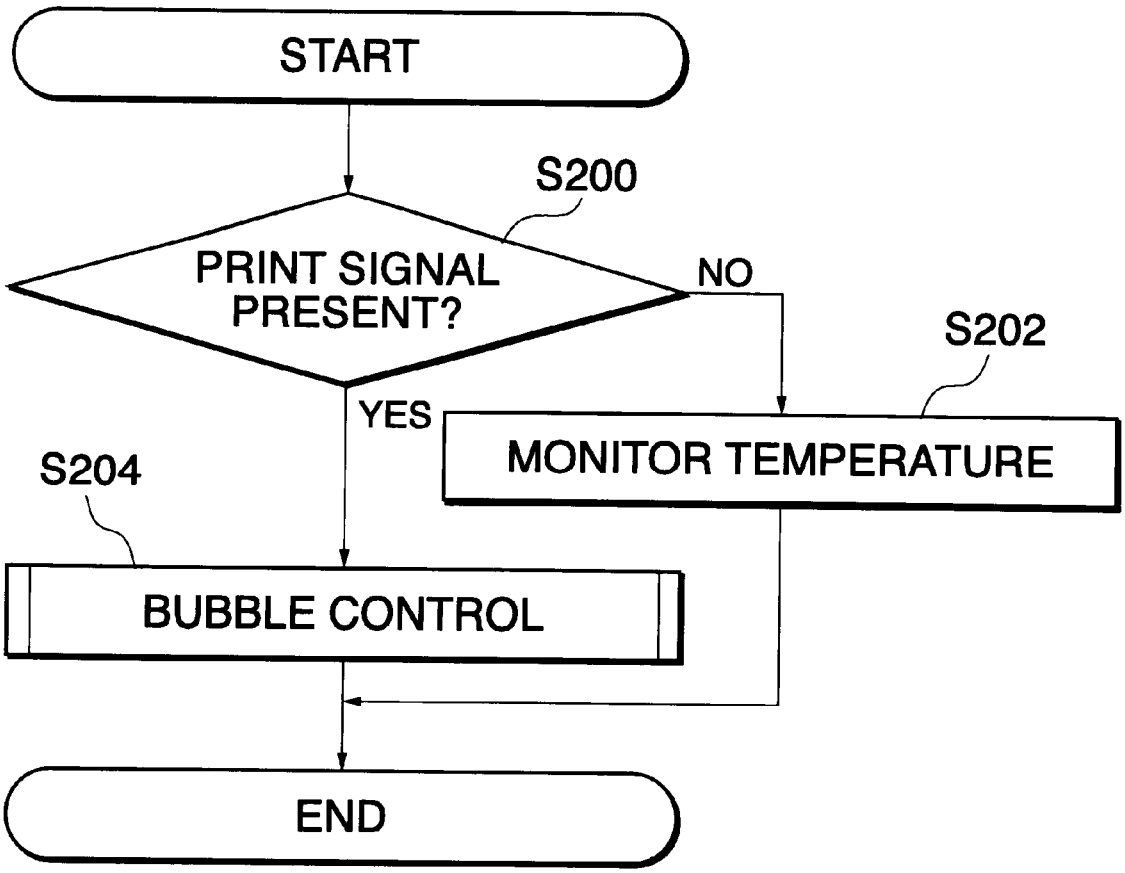
FIG. 6 is a main flowchart showing bubble control.

It is understood from FIG. 5 that, in the embodiment example, only bubbles having a diameter of up to 17 μm flow into the head in a flow velocity of a printing rate range of 5 to 100%.

In contrast, in the comparative example, since ink flow velocity is fast, bubbles as large as 76 to 430 μm flow into the head together with ink, in a flow velocity of a printing rate range of 5 to 100%.

In contrast, a bubble size to cause bubble-induced printing defects is decided by a individual flow passage pitch Np. In other words, because 800 dpi is used as Np in the test example, a pitch Np between adjacent individual flow passages 32 (ink emission orifices 30) is 31.75 μm because of Np=25400 μm/80=31.75 μm. Therefore, it is understood that a bubble size to cause bubble-induced printing defects is 62.5 μm or more.

Therefore, in the embodiment example, regardless of printing rates, since bubbles to cause bubble defects do not flow into the head (the bubbles rise within the ink supply chamber), bubble-induced printing defects will not occur. On the other hand, in the comparative example, since bubbles of 62.5 μm or more flow into the head with a certain probability without causing no printing defects, bubble-induced printing defect will occur for printout of about 300 sheets.

In this way, in the embodiment example, by increasing the cross-sectional area of the ink supply chamber 44 in the ink flow direction in comparison with the comparative example, ink flow velocity in the ink supply chamber at the time of printing is controlled below a predetermined value, bubbles of such a size as to cause bubble-induced printing defects are made to rise by buoyancy. Therefore, the occurrence of bubble-induced printing defects can be completely prevented without having to perform maintenance.

(Second Effect)

The second effect of the cartridge 14 is to prevent the situation in which bubbles within the ink supply chamber 44 grow, ink within the ink supply chamber 44 becomes empty, and ink to the individual flow passages 32 cannot be supplied, so that printing cannot be performed.

To achieve such purposes, the cartridge 14 is designed so that bubbles grow actively within the ink tank chamber 42 communicating to the ink supply chamber 44, instead of growing them in the ink supply chamber 44.

Generally, gas which deposits from a liquid grows a bubble integrally with a bubble that already exists in the liquid. Therefore, if a bubble exists in the ink supply chamber 44, the gas deposited according to a rise in ink temperature accompanying printing operation grows the bubble.

Accordingly, the cartridge 14 is constructed so that no bubble exists in the ink supply chamber 44 at the time of shipment, and an air lump 48 having a capacity of 1 $mm^3$ or more is sealed in the ink tank chamber 42 which communicates with the ink supply chamber 44 through the filter 40 and in which ink is held in free condition. Therefore, the ink heated in the course of printing operation reaches the ink tank chamber 42 by convection and deposits air. As a result, the air lump 48 sealed beforehand is grown by the deposited gas, whereby the bubble occurrence and growth within the ink supply chamber 44 can be restrained.

If the capacity of an air lump sealed beforehand is below 1 $mm^3$, because the diameter of the air lump (bubble) is small, the bubble may dissolve (disappear) because of a rise in ink temperature and the bubble may grow within the ink supply chamber 44.

The present invention also intends to restrain bubble occurrence itself.

Generally, there are two kinds of causes of bubble occurrence within the cartridge 14: (1) since the solubility of air to ink falls as ink temperature rises during printing, minute bubbles deposit in the ink and grow, result in occurrence of bubbles; and (2) there is always a pressure difference from the external atmosphere within the cartridge 14 because ink is supplied to the ink emission orifice 30 with negative pressure, and the pressure difference causes the phenomenon of gas transmission that surrounding air invades through members constituting the cartridge 14, result in occurrence of bubbles.

The cartridge 14 uses noryl resin (or PPO (polyphenylene oxide)) for the ink supplier 22 and elastomer of a polystyrene system for an elastic seal member 46 that seals the head chip 20 and the ink supply chamber 44. Since both of them have sufficiently small gas transmission constants and have inside-outside pressure difference as small as 1000 Pa, a gas transmission quantity (bubble occurrence of (2)) of surrounding air can be almost disregarded in the period of several years after start of use.

Figure 9:
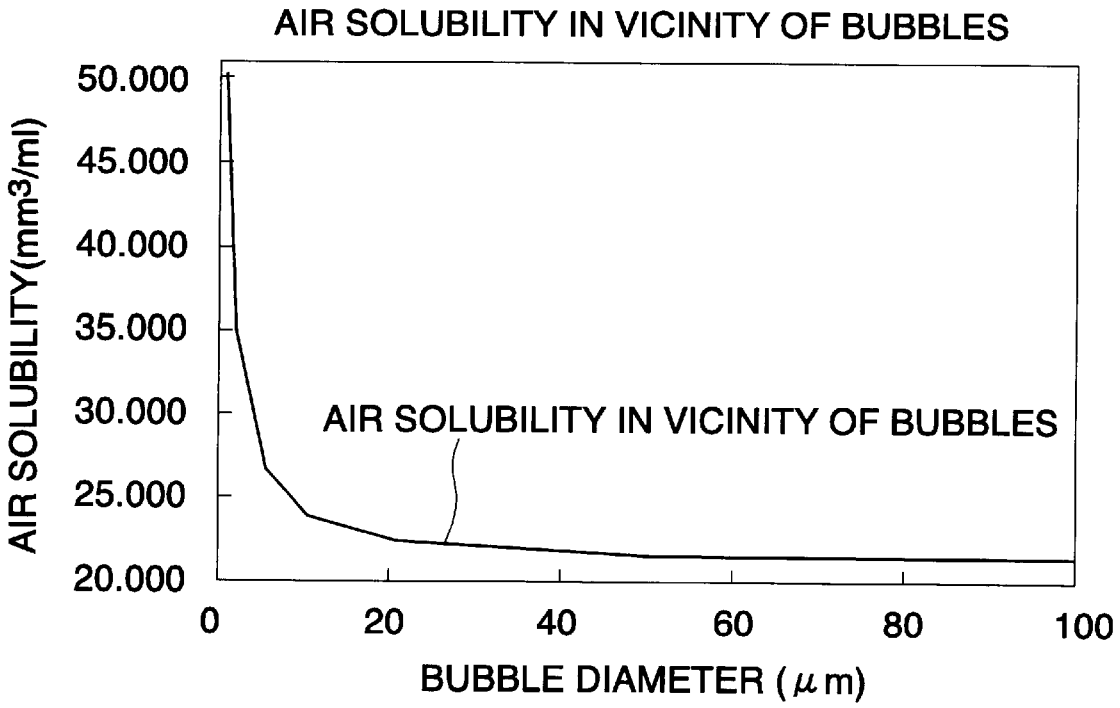
FIG. 9 is a graph showing the relationship between bubble size in water and air solubility in the vicinity of bubbles.

Therefore, bubble occurrence in the cartridge 14 is considered to be caused by a temperature rise (the cause of (1)) of ink. Generally, liquid, e.g., water decreases in the solubility of air as temperature rises (see FIG. 8). Therefore, air deposits from ink by a temperature rise accompanying printing operation. Of course, the bubble dissolves in ink upon a fall in ink temperature at the end of printing operation, but several bubbles exceeding a certain size do not dissolve. This is because the relationship between the size of a bubble and the solubility of liquid, e.g., water satisfies the relationship as shown in FIG. 9. Therefore, bubble growth must be controlled so that bubbles that occurred in the ink supply chamber 44 dissolve in ink again when printing is halted.

To allow bubbles to dissolve in ink again when printing is halted (a fall in ink temperature), it was confirmed by a test described below whether printing should be halted when how much ink has been consumed.

(Test)

In the cartridge 14 of the embodiment example, by modifying the number of sheets of one job (the number of sheets that is continuously printed) to print 30,000 sheets of paper of A4 size, the condition that bubbles dissolve in ink was obtained. The internal volume of the ink supply chamber 44 was 3000 $mm^3$. The capacity of ink of free condition in the ink tank chamber 42 before the cartridge 14 was used (hereinafter referred to as initial state) was 4000 $mm^3$ and head temperature during print job was about 55° C. The head temperature was naturally cooled to the room temperature 25° C. after each print job.

When printing was performed on paper of A4 size (210 mm×300 mm) with 800 dpi and a printing rate of 5%, the consumption of ink per page was estimated as 16 $mm^3$ from $5pl\times800\times800\times(210/25.4\times300/25.4)\times0.05$.

The number of a series of print jobs, and the quantity of bubbles that occurred in the ink supply chamber are shown in Table 2.

TABLE 2

| NUMBER OF PRINT JOBS (WITH PRINTING COVERAGE OF 5%) | TOTAL VOLUME OF EMITTED INK FOR EACH PRINT JOB ($mm^3$) | QUANTITY OF BUBBLES OCCURRING IN INK SUPPLY CHAMBER ($mm^3$) | CAPACITY OF AIR LUMP WITHIN INK TANK CHAMBER (1 to 10 $mm^3$ IN INITIAL STATE) |
|---|---|---|---|
| 100 SHEETS × 300 JOBS | 1600 | 0 | 3100 |
| 200 SHEETS × 150 JOBS | 3200 | 0 | 3200 |
| 400 SHEETS × 75 JOBS | 6400 | 50 | 3010 |
| 500 SHEETS × 60 JOBS | 8000 | 400 | 2500 |
| 1000 SHEETS × 30 JOBS | 16000 | 1000 | 1980 |
| 3000 SHEETS × 10 JOBS | 48000 | 2000 | 1000 |

Ink temperature is about 20° C. under the environment of the room temperature 25° C. and the ink in the vicinity of the head rises in temperature to about 50 to 55° C. during printing. From, this, if the amount of deposited air per unit ink quantity is estimated on the basis of the difference of the solubility of air to water (see FIG. 8), the very large value of 75 $mm^3$ (amount of deposited air)/1000 $mm^3$ (printing ink quantity) is obtained. From this value, the amount of air generated per 30,000 sheets in Table 2 (the amount of air generated in the ink supply chamber and the ink tank chamber) is estimated as 3600 $mm^3$. This matches well the result of Table 2.

It is understood from the test results that, for the total amount of emitted ink as small as the capacity (3000 $mm^3$) of the ink supply chamber 44, bubbles (hereinafter referred to as residual bubbles) that do not dissolve in the ink will not occur in the ink supply chamber 44 even if it the temperature falls after the job comes to an end. On the other hand, in the ink tank chamber 42, the air lump 48 grows, because the ink heated by convection invades from the ink supply chamber 44.

Also, it was confirmed that residual bubbles occurred for the total amount of emitted ink of the vicinity of the sum (7000 $mm^3$) of the capacity of the ink supply chamber 44 and the initial ink capacity (4000 $mm^3$) in the ink tank chamber 42.

Therefore, if the total volume of ink emitted from the ink emission orifices during one printing job is smaller than the sum (7000 $mm^3$) of the capacity of the ink supply chamber and the capacity of ink held in free condition, few bubbles occur within the ink supply chamber 44. Therefore, by making the total amount of ink emitted during continuation printing smaller than the above-described sum, it becomes possible to eradicate bubbles that remain and grow in the ink supply chamber and establish the situation in which only the air lump 48 of the ink tank chamber 42 in free condition grows.

Figure 7:
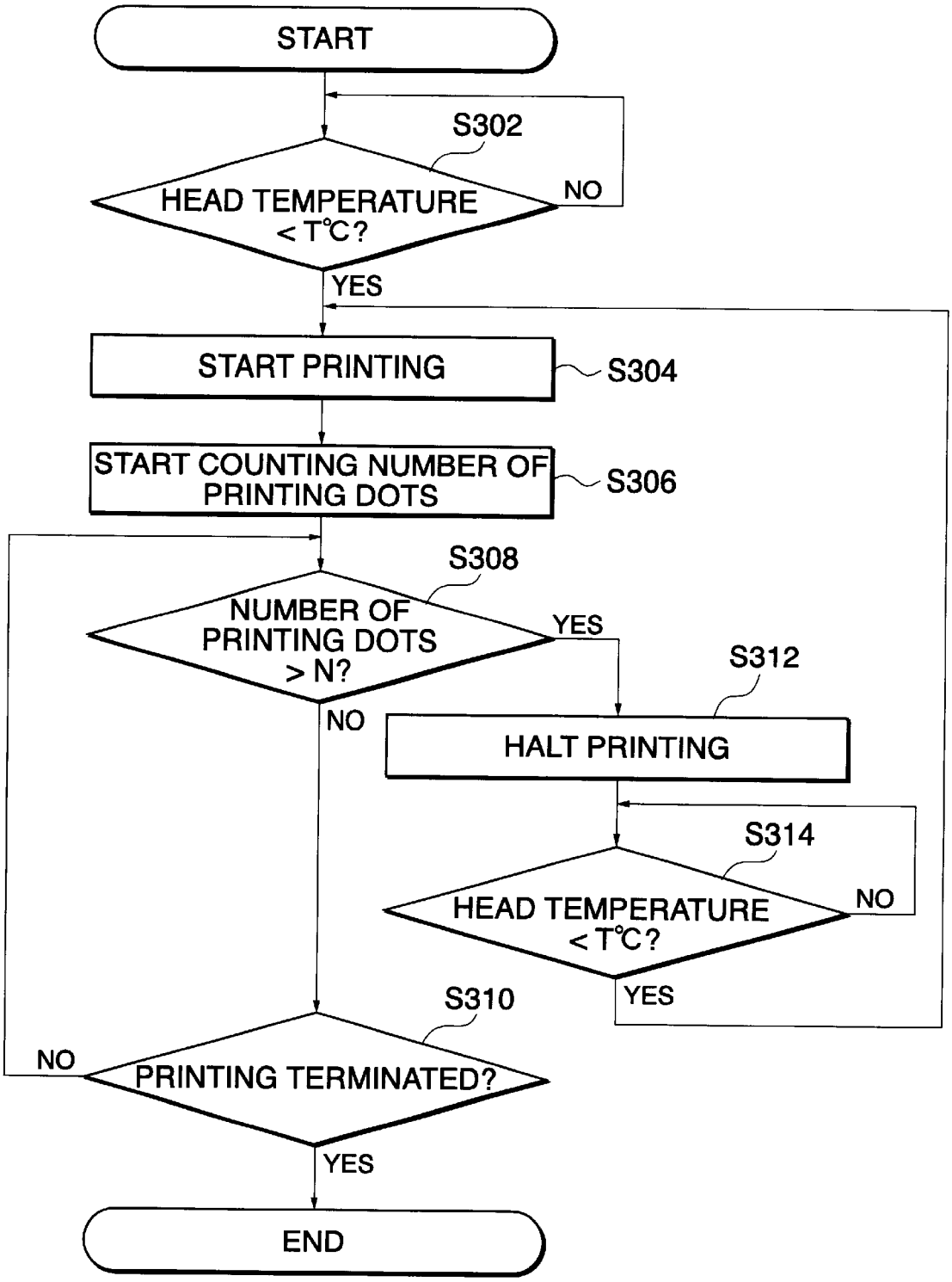
FIG. 7 is a flowchart showing bubble control.
Figure 8:
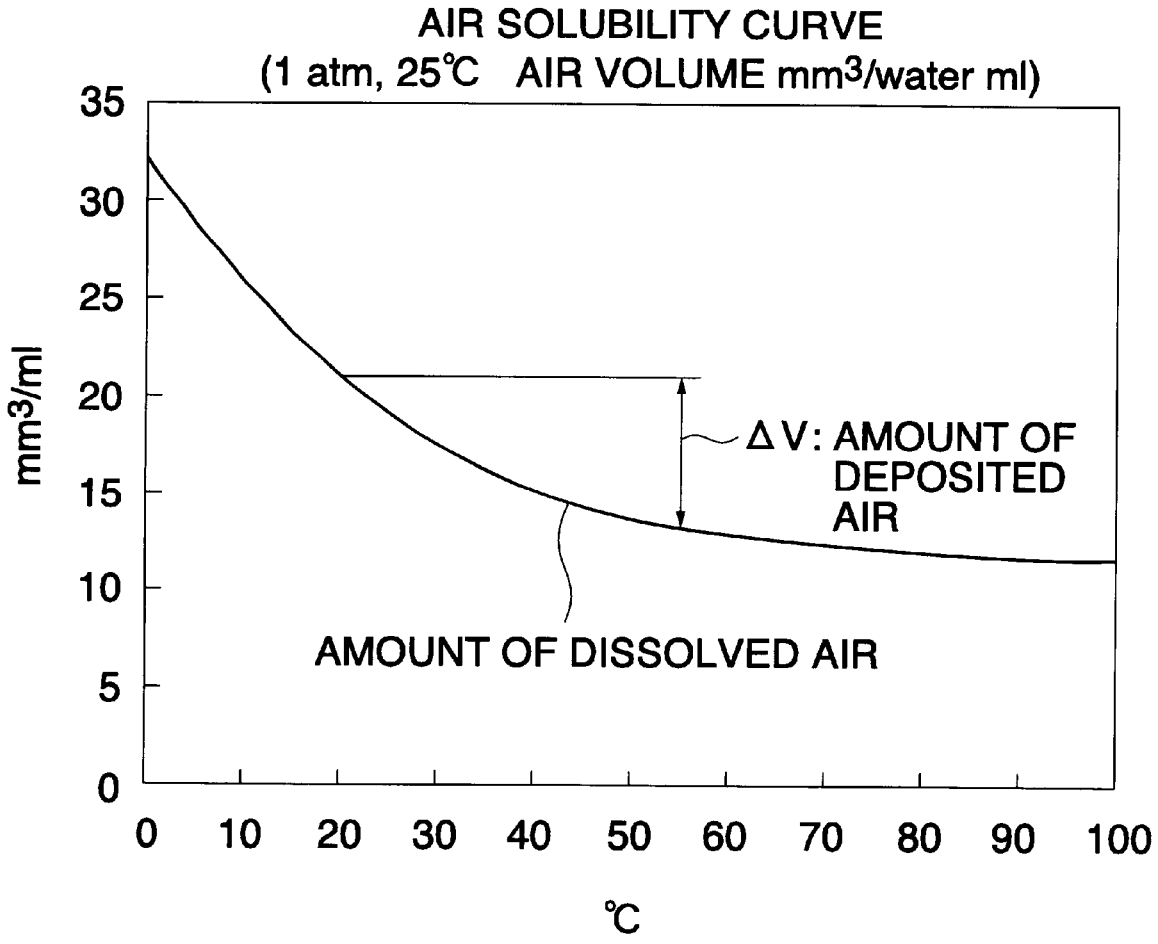
FIG. 8 is a graph showing the relationship between water temperature and air solubility.

Based on such knowledge, the inkjet recording apparatus 10 performs the bubble occurrence prevention control as shown in FIG. 7. Details are given referring to the flowcharts shown in FIGS. 6 and 7.

A control part (not shown) of the inkjet recording apparatus 10 detects ink temperature of the ink supply chamber 44 by a temperature sensor (not shown) until a printing signal is inputted (steps 200 and 202).

When the printing signal is inputted to the control part, a bubble control subroutine is started (step 204).

When the printing signal is input, the bubble control subroutine determines whether or not ink temperature in the ink supply chamber 44 is below a predetermined temperature T ° C. (T=25° C. in the present embodiment) (step 302).

When a detected temperature becomes below the predetermined temperature T ° C., by driving the heat generating element 36, the subroutine emits ink from the ink emission orifices 30 and starts printing (step 304).

As soon as printing is started, a determination unit 1 counts the total number of printing dots that were emitted from all the ink emission orifices 30 constituting the cartridge 14 (step 306). By multiplying a drop quantity and the number of printing dots, the total amount of emitted ink is checked.

Next, the subroutine determines whether the number of printing dots exceeds a specified number N of dots (step 308). In the present embodiment, a value obtained by multiplying this specified number N of dots and the drop quantity is the number of printing dots equivalent to the total ink capacity of the ink supply chamber 44 and the ink tank chamber 42.

If the number of printing dots is smaller than the specified number N of dots, the subroutine determines whether printing terminates (step 310). If a series of jobs terminate, the bubble control subroutine is terminated and control is again transferred to the monitoring of ink temperature of the ink supply chamber 44.

On the other hand, if the jobs do not terminate, the above-described control is repeated until the number of printing dots exceeds the specified number N of dots.

A printing control unit 2 wherein if the number of printing dots exceeds the specified number N of dots, halts printing operation (ink emission) temporarily until the temperature of ink of the ink supply chamber 44 becomes below the predetermined temperature T ° C. (steps 312 and 314). This is done since if the total amount of emitted ink exceeds the sum of the capacity of the ink supply chamber 44 and the initial quantity of ink of free condition in the ink tank chamber 42, an ink heating quantity becomes large, bubbles within the ink supply chamber grow excessively, and deposited bubbles do not disappear (not redissolve) after printing halt. In other words, by temporarily halting the printing to decrease the ink temperature, bubbles that deposited in the ink supply chamber 44 are redissolved regardless of a fall in the ink temperature to prevent the bubbles from remaining (occurring) in the ink supply chamber 44.

If the number of printing dots exceeds the specified number N of dots, printing operation (ink emission) is temporarily halted until the temperature of ink of the ink supply chamber 44 becomes below the predetermined temperature T ° C. (steps 312 and 314). This is done since if the total amount of emitted ink exceeds the sum of the capacity of the ink supply chamber 44 and the initial quantity of ink of free condition in the ink tank chamber 42, an ink heating quantity becomes large, bubbles within the ink supply chamber grow excessively, and deposited bubbles do not disappear (not redissolve) after printing halt. In other words, by temporarily halting the printing to decrease the ink temperature, bubbles that deposited in the ink supply chamber 44 are redissolved regardless of a fall in the ink temperature to prevent the bubbles from remaining (occurring) in the ink supply chamber 44.

If a ink temperature in the ink supply chamber 44 becomes below the predetermined temperature T ° C., printing is resumed for remaining jobs (step 304), the number of printing dots is cleared, and counting is started again (step 306). This is because it is judged that the deposited air has dissolved in the ink again, if the ink temperature becomes below the predetermined temperature T ° C.

By controlling printing operation in this way, it can be prevented that bubbles deposit in the ink supply chamber, and the deposited bubbles grow without redissolving regardless of a fall in ink temperature and prevent ink supply.

In the present embodiment, if the total amount of emitted ink exceeds the sum of the capacity of the ink supply chamber 44 and the initial quantity of ink of free condition in the ink tank chamber 42, printing is temporarily halted. However, by performing control so that printing is temporarily halted for a smaller quantity than the above-described sum, the occurrence of residual bubbles within the ink supply chamber can be prevented without fail.

(Third Effect)

A third effect of the cartridge 14 is to restrain fluctuations of ink meniscus interface of the ink emission orifices 30 at the time of ink emission and enable stable printing regardless of printing condition.

Figure 10:
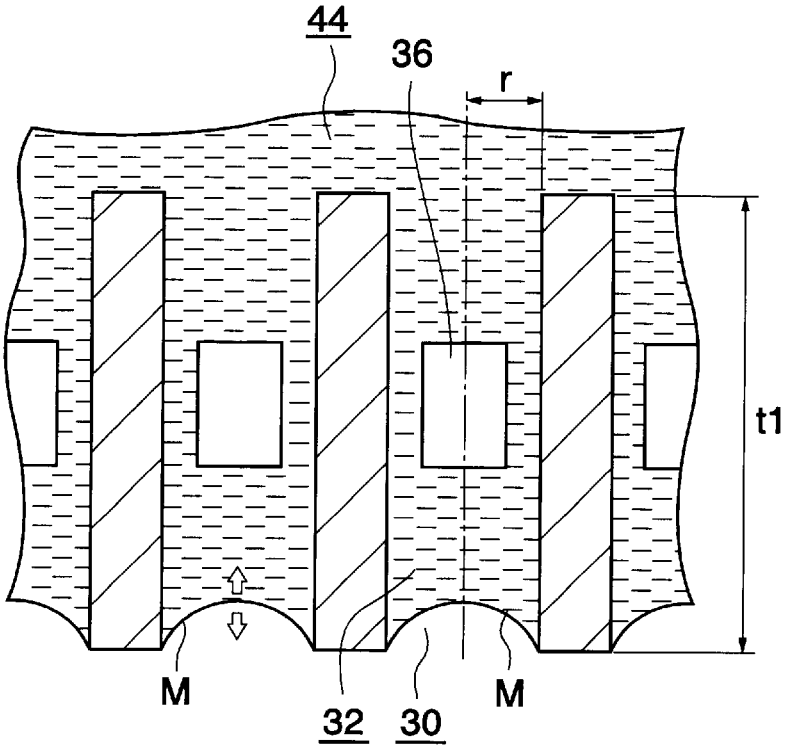
FIG. 10 is a plan view showing individual flow passages of the inkjet recording head cartridge according to the present invention.

As shown in FIG. 10, the ink meniscus interface M oscillates by ink emission. This amplitude is amplified depending on printing condition (the pressure condition of the ink supply chamber 44) and the meniscus interface M migrates to the ink supply chamber 44 beyond the heat generating element 36, so that an ink emission failure might occur. Accordingly, in the present embodiment, arrangements have been made so that the amplitude of the ink meniscus interface M caused by ink emission is not amplified regardless of printing condition to enable stable printing.

Since the oscillation of the ink meniscus interface M is determined by the pressure oscillation of the ink supply chamber 44, control is performed so that the pressure oscillation does not amplify.

Figure 12:
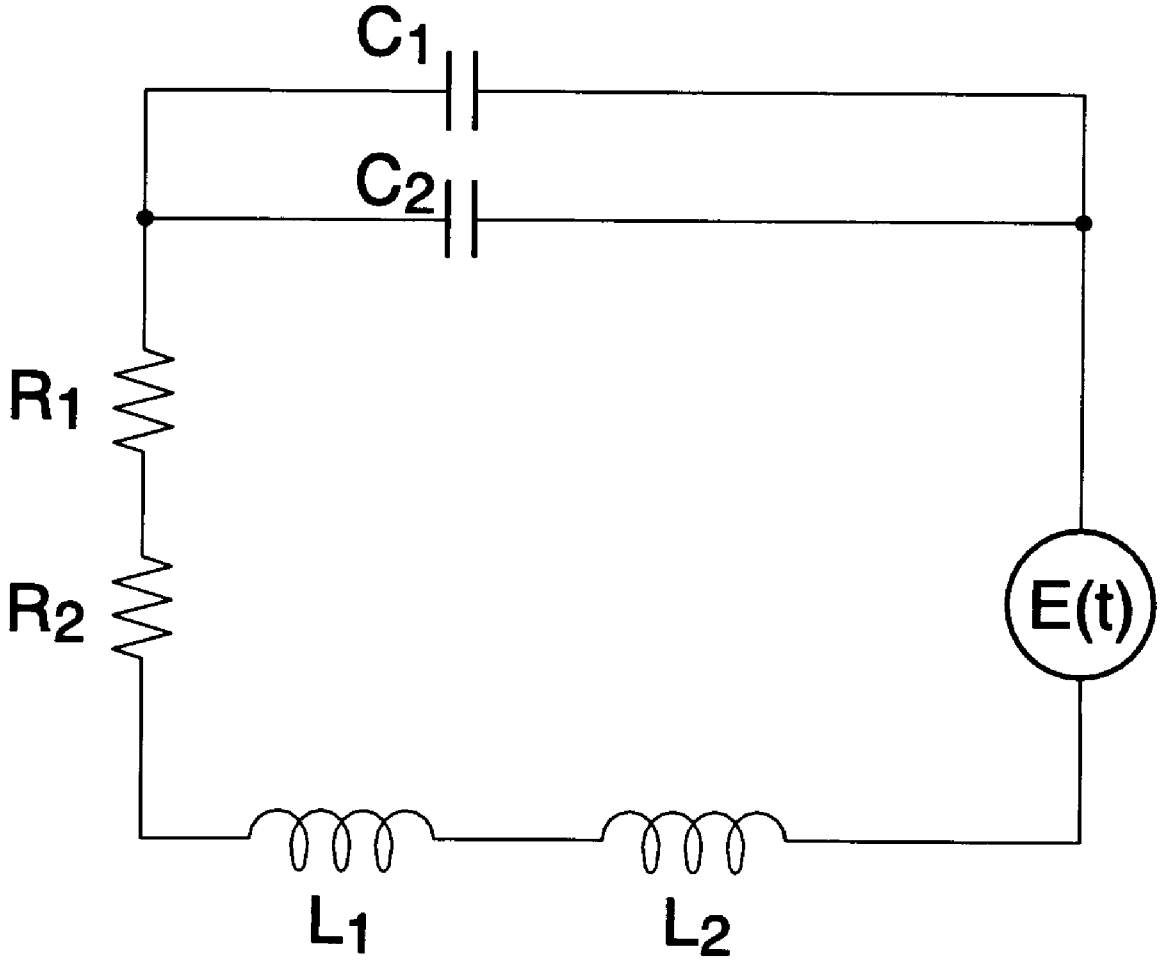
FIG. 12 is a drawing showing a fluid pressure electricity equivalent circuit of the inkjet recording head cartridge according to the present invention.

When a pressure pulse in the ink supply chamber 44 that occurs during ink emission is expressed by the function of E(t), a pressure electricity equivalent circuit is shown in FIG. 12. Here, a flow passage resistance of the individual flow passages 32 is R1; a capacitance by the ink meniscus interface of the ink emission orifices 30 is C1; an inertance of the individual flow passages 32 is L1; a flow passage resistance of the ink supply chamber 44 is R2; a capacitance of ink supply chamber 44 is C2; and an inertance of the ink supply chamber 44 is L2.

At this time, a fluid pressure oscillation equation can be expressed by the following expression, letting a pressure in the ink supply chamber be P.

$$(L1+L2)d^2P/dt^2+(R1+R2)dP/dt+P/(C1+C2)=E(t) \quad (7)$$

By solving this differential equation, a pressure P in the ink supply chamber 44 is found.

Since ink emission is cyclically repeated, an emission-induced pressure pulse E(t) that occurs in the ink supply chamber 44 is decided by ink emission. Also, fluid pressure oscillation in the ink supply chamber 44 is conceivable as a forced oscillation system because the excitation of ink emission is applied.

The characteristic of the forced oscillation system is that resonance is caused if an oscillation frequency of a pressure pulse E(t) outputted from the outside matches the natural frequency of the system. Especially in a system free of attenuation (flow passage resistance), a pressure amplitude is infinitely extended.

Also, in a system in which attenuation (flow passage resistance) exists, if attenuation ratio ζ is represented as $$\zeta=[(R1\times R2)/2\times\{(C1+C2)/(L1+L2)\}]^{1/2},$$

amplitude X would be amplified to $1/\{2\times\zeta\times(1-\zeta^2)^{1/2}]$ times.

Because of the amplitude amplification, in the case where, in the recording head cartridge of the comparative example, a pattern having a high printing rate (batch printing of 100%) is repeatedly printed at a certain period, a nonemission fault such as a white stripe occurred.

In the embodiment example, by satisfying a relational expression derived from a characteristic equation of an expression (7)

$$(R1+R2)^2\times(C1+C2)\geqq 4\times(L1+L2) \quad (8)$$

pressure oscillation in the ink supply chamber during ink emission can be made into an overattenuation mode or critical attenuation mode. As a result, because the pressure oscillation in the ink supply chamber becomes nonoscillation type, the pressure fluctuation of the ink supply chamber 44 is not amplified even if a pressure pulse E(t) of any oscillation frequency is applied.

In the case where a construction as in the comparative example is taken, because the cross-sectional area S of the ink pipeline 118 is small, the value of L2 becomes large and the expression (8) cannot be satisfied, and therefore pressure fluctuation will be amplified. Accordingly, to satisfy the characteristic equation, the amplification of pressure fluctuation was restrained, for example, by generating a bubble and sending it to the common liquid chamber 34 and increasing capacitance C2 by the bubble. However, it was difficult to control the bubble sent to the common liquid chamber 34 and there was the possibility that the bubble grew in the course of printing operation and an emission defect might occur.

On the other hand, the embodiment example constructs the cartridge 14 by designing it so that the values of R1, R2, L1, L2, C1, and C2 satisfy the expression (8) by adjusting the dimensions of the cartridge 14 described later. Thereby, very satisfactory printing can be achieved for any image quality pattern and a reliable recording head cartridge 14 can be formed.

For example, by increasing the cross-sectional area of the ink supply chamber 44, pressure oscillation during ink emission can be completely attenuated, and very satisfactory printing can be achieved for any image quality pattern and a reliable recording head cartridge can be formed.

By the way, resistance R1 in the individual flow passages, by circular tube approximation, is represented as $$R1=8\times\mu\times t1/(\pi r^4).$$

Herein, $\mu$ is ink viscosity; t1 is the length of individual flow passage; and r is the cross-sectional radius of individual flow passage. The same is also true for the resistance R2 of the ink pipeline line of the comparative example (1: the length of ink pipeline) (see FIG. 4).

On the other hand, the resistance R2 of the rectangular ink supply chamber of the embodiment example can be obtained by applying circular tube approximation to the sectional shape.

Inertance L1 in the individual flow passages, by circular tube approximation, is represented as $$L1=\rho\times t1/(\pi r^2).$$

Herein, ρ is ink density. The same is also true for the inertance L2 of the ink pipeline of the comparative example (see FIG. 4).

On the other hand, inertance L2 of the rectangular ink supply chamber 42 of the embodiment example is represented as $$L2=\rho\times t2/S.$$

Figure 11:
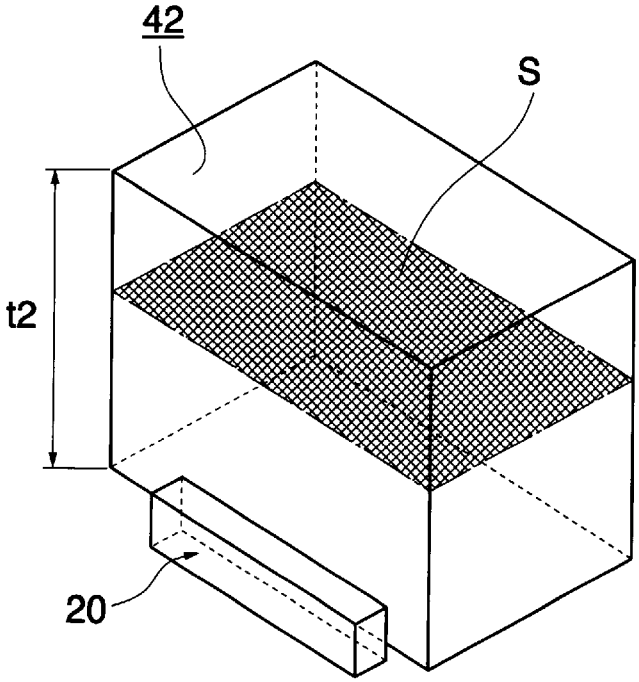
FIG. 11 is an explanatory view showing the dimension of an ink supply chamber of the inkjet recording head cartridge according to the present invention.

Herein, t2 is the length of the ink supply chamber, and S is the cross-sectional area of the ink supply chamber (see FIG. 11).

Capacitance C2 of the ink supply chamber means acoustic capacity and is represented as $$C2=V/(\rho\times C^2).$$

Herein, V is the capacity of the ink supply chamber and C is acoustic velocity in the ink. The same is also true for the capacitance C2 of the ink pipeline of the comparative example.

On the other hand, a capacitance C1 by the ink meniscus interface of the ink emission orifice means a capacity by meniscus displacement and is represented as $$C1=dV/PC.$$

Herein, dV is an ink drop volume and PC is a capillary tube pressure of the meniscus in the ink emission orifice. The capillary tube pressure PC is represented as $$PC=2\gamma\cos\theta/r.$$

Herein, γ is an ink surface tension, θ is an emission orifice contact angle, and r is an emission orifice radius.

(Test Example)

Printing evaluation was made for the cartridge 14 (inkjet recording apparatus 10) of the embodiment example and the comparative example by printing line pairs each having a predetermined number of dots. Numeric values obtained from the embodiment example in the test example and the comparative example are shown in Table 3.

TABLE 3

| CONSTANT | EMBODIMENT EXAMPLE | COMPARATIVE EXAMPLE | UNIT |
|---|---|---|---|
| R2 | $2.55\times10^{3}$ | $1.38\times10^{9}$ | Pa•sec./m$^3$ |
| R1 | $1.12\times10^{11}$ | $1.12\times10^{11}$ | Pa•sec./m$^3$ |
| L2 | $3.67\times10^{4}$ | $2.34\times10^{7}$ | kg/m$^4$ |
| L1 | $1.05\times10^{6}$ | $1.05\times10^{6}$ | kg/m$^4$ |
| C2 | $1.21\times10^{-15}$ | $5.20\times10^{-18}$ | m$^3$/Pa |
| C1 | $1.94\times10^{-16}$ | $1.94\times10^{-16}$ | m$^3$/Pa |
| μ (AT ROOM TEMPERATURE) | $2.01\times10^{-3}$ | $2.01\times10^{-3}$ | Pa•sec. |
| μ (DURING EMISSION) | $1.00\times10^{-3}$ | $1.00\times10^{-3}$ | Pa•sec. |

Figure 13:
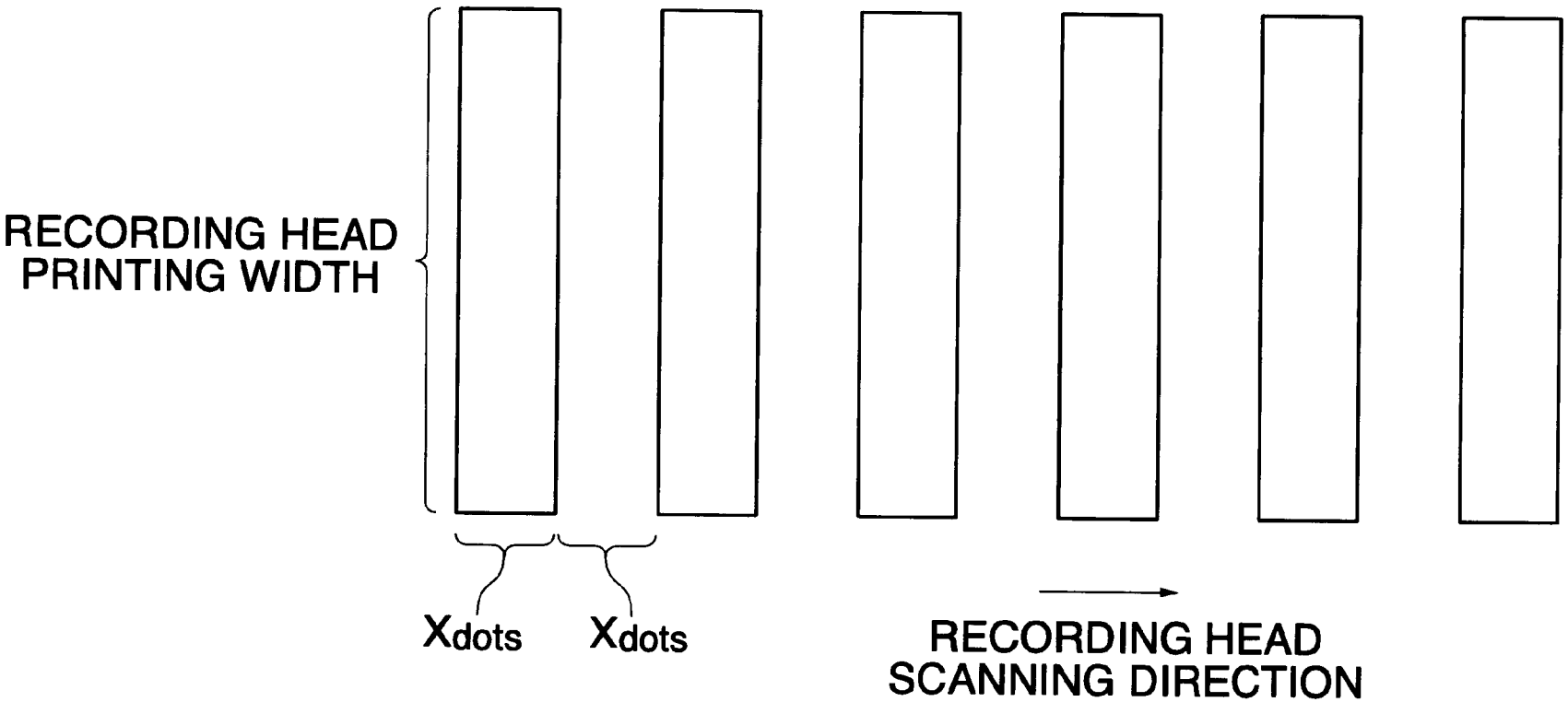
FIG. 13 is an explanatory view of line pairs.
Figure 14:
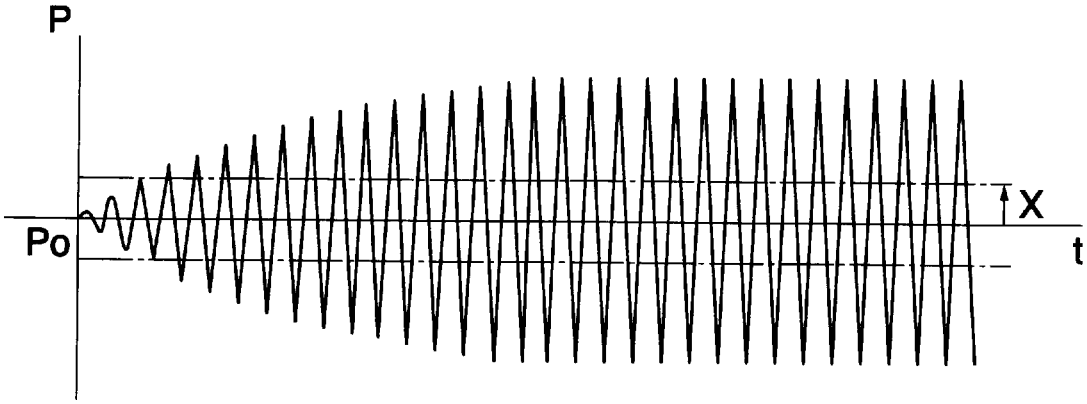
FIG. 14 is a drawing showing the amplitude condition of an ink supply chamber of the comparative example.
Figure 15:
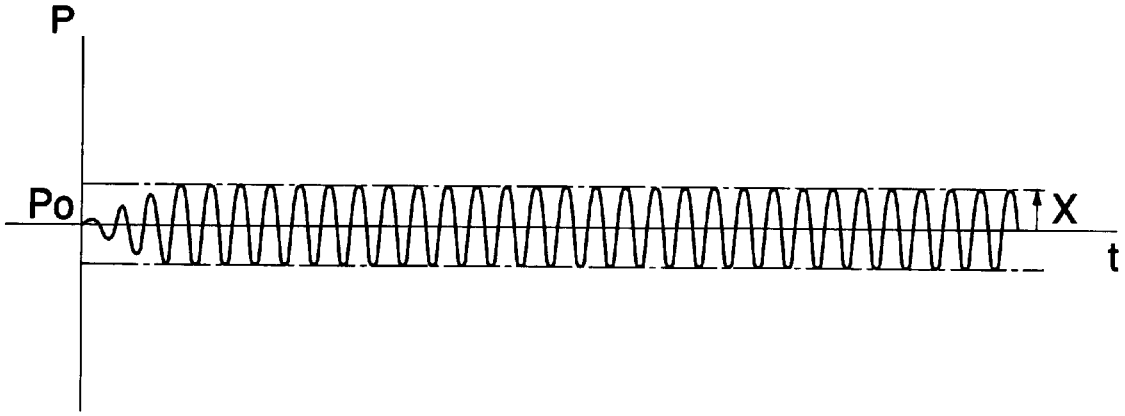
FIG. 15 is a drawing showing the amplitude condition of the ink supply chamber of the embodiment example.

FIG. 13 is an explanatory drawing showing the line pairs used for the printing evaluation. Specifically, full width batch printing (printing rate 100%) of the recording head is performed with the printing pattern that a null part of x dots is formed after x dots are continuously emitted, at a printing spatial frequency 1/(2×x) times an emission frequency.

By printing the x-dot line pairs in the range in which x is from 1 to 20, printing evaluation was performed. Printing evaluation results and amplitude amplification factors are shown in Table 4.

The natural frequency F is a value obtained by an expression:

$$F=[1/(2\pi)]\times[1/(LC)]^{1/2}.$$

TABLE 4

| | EMBODIMENT EXAMPLE | COMPARATIVE EXAMPLE |
|---|---|---|
| $(R1+R2)^2\times(C1+C2)-4\times(L1+L2)$ | $1.32\times10^{7}$ | $-9.53\times10^{7}$ |
| ATTENUATION RATIO ζ | 2.01 | 0.159 |
| AMPLITUDE AMPLIFICATION FACTOR | NOT AMPLIFIED | 3.18 TIMES |
| NATURAL FREQUENCY OF INK SUPPLY SYSTEM Hz | 4072 | 2282 |
| PRINTING EVALUATION RESULTS | NO PROBLEM OCCURRED AFTER 1- TO 20-DOT LINE PAIRS WERE REPEATEDLY PRINTED AT 20 KHZ. | WHITE DROPOUT OCCURRED AFTER 4- TO 5-DOT LINE PAIRS WERE REPEATEDLY PRINTED AT 20 KHZ. |

It is understood from these results that the expression of $(R1+R2)^2\times(C1+C2)-4\times(L1+L2)<0$ is satisfied in the comparative example, indicating attenuation oscillation mode. Therefore, if input (4- to 5-dot line pairs at 20 kHz) having an oscillation frequency in the vicinity of the natural frequency of the ink supply system is repeated, the amplitude of pressure oscillation increases to 3.18 times the initial amplitude (see FIG. 14).

If the cartridge goes into such resonance condition, the refill of ink meniscus M formed in the individual flow passages 32 becomes unstable, eventually the ink is not emitted, and a printing defect such as white dropout occurs.

On the other hand, the embodiment example satisfies the expression of $(R1\times R2)^2\times(C1+C2)-4\times(L1+L2)>0$, indicating overattenuation mode. Therefore, because the amplitude of pressure oscillation does not increase and is almost the same as the input (see FIG. 15), reliable ink emission (printing) becomes possible.

Viscosity μ differs between at the time of ink emission and at the room temperature (standby). This is because the ink is heated during ink emission, with result that ink temperature in the vicinity of the individual flow passages rises and the viscosity decreases.

The cartridge 14 has the following effect, in addition to the aforementioned first to third effects.

That is, since the head chip 20 forms a part of the side of the ink supply chamber 44 and the individual flow passages 32 open directly to the large-capacity ink supply chamber 44, the ink is easily diffused and the ink emission orifices 30 (individual flow passages 32) are not clogged because of dry ink after the cartridge 14 has been left unused for a long period of time. Therefore, the life of the cartridge 14 can be extended.

In this way, the present invention can offer the reliable cartridge 14 and inkjet recording apparatus 10 with a simple constitution.

Such a huge air lump of the ink tank chamber 42 described in the second effect as to block the upper part of the filter 40 can be prevented by exhausting air from the ink tank chamber 42 and providing an ink supply system to replace ink.

Figure 16A:
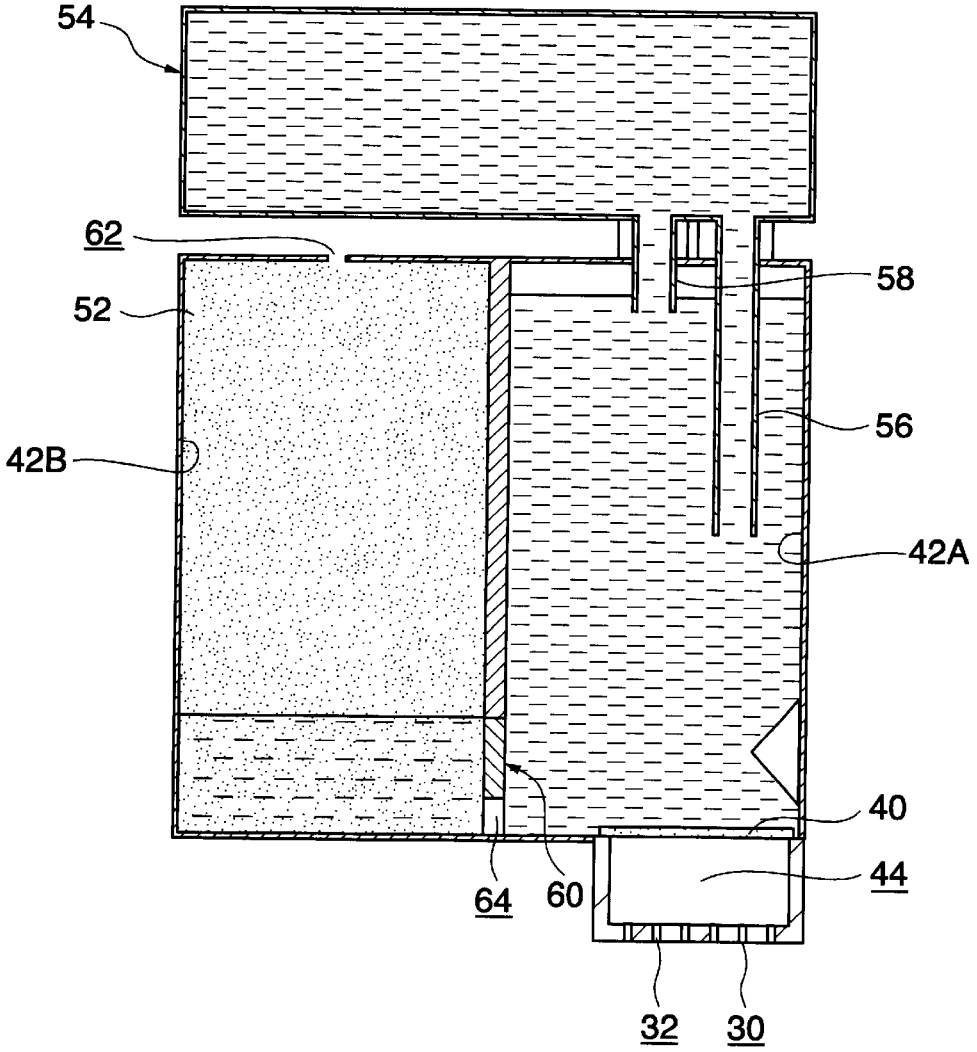
FIG. 16 is a drawing showing an example of another inkjet recording head cartridge.

An example is shown in FIG. 16. In other words, a cartridge 50, which has an ink tank chamber 42 made up of two cells, includes a first ink chamber 42A that communicates directly with an ink supply chamber 44 through a filter 40 and in which ink is held in free condition, a second ink chamber 42B in which a porous member 52 impregnated with ink is disposed, and a secondary ink tank 54 that supplies ink to the first ink chamber 42A.

The secondary ink tank 54 communicates with the first ink chamber 42A through two communication tubes 56 and 58 different from each other in length.

Figure 16B:
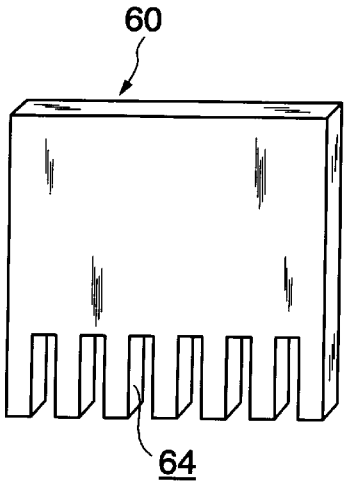

The first ink chamber 42A and a lower part of the second ink chamber 42B are communicated with each other through clearances 64 of a communication member 60 (see FIG. 16B).

With this constitution, when ink emission is started and the ink of the first ink chamber 42A is consumed, air is introduced from the opening 62 of the second ink chamber 42B, and the ink impregnated in the porous member 52 flows into the first ink chamber 42A through the clearances 64 of the communication member 60. When the ink surface of the second ink chamber 42B drops to the location of the clearances 64 of the communication member 60, air is introduced directly to the first ink chamber 42A from the porous member 52. In this condition, when the ink surface of the first ink chamber 42A falls to a predetermined position, the ink of the secondary ink tank 54 replaces the air of the first ink chamber 42A through the communication tubes 56 and 58.

In this way, since the ink in the secondary ink tank 54 replaces the air in the first ink chamber 42A, the air accumulated in the first ink chamber 42A can be discharged. Therefore, it is possible to prevent a fault that the air accumulated in the first ink chamber 42A grows excessively and blocks the filter 40.

Also, since a liquid surface detection sensor provided in the first ink chamber 42A detects the quantity of remaining ink in the first ink chamber 42A and tells the replacement of the secondary ink tank, it is prevented without fail that too small a quantity of remaining ink in the first ink chamber 42A promotes bubble occurrence and growth in the ink supply chamber 42.

The inkjet recording apparatus and the inkjet recording head cartridge of the present invention prevent bubble-induced printing defects and can implement a reliable recording head.

Also, the fault that ink is not emitted because the ink supply chamber has been filled with bubbles can be prevented and the life of the head can be extended.

Furthermore, by optimally designing the internal volume, cross-sectional area, and length of the ink supply chamber, a pressure oscillation during ink emission can be completely attenuated, and satisfactory printing can be achieved for whatever image quality pattern.

As has been described above, by adopting the present invention, an inkjet recording head cartridge and an inkjet recording apparatus, both highly reliable and low-cost, can be achieved.

The entire disclosure of Japanese Patent Application No. 2000-223037 filed on Jul. 24, 2000 including specification, claims, drawings and abstract is incorporated herein by reference in its entirety.

What is claimed is:

1. An inkjet recording head cartridge, comprising:

a substrate formed to have individual flow passages each having an ink emission orifice at one end thereof and an ink inflow orifice at another end thereof;

an ink supply chamber communicating with the ink inflow orifices; and a heater face provided to be orthogonal to an ink emission face on which the ink orifices are formed, the heater face being part of a side surface of the ink supply chamber, wherein the ink supply chamber is formed to have a cross-sectional area allocated in an ink flow direction so that when ink is emitted from all the ink emission orifices, a buoyancy acting on a bubble occurring in the ink supply chamber, is larger than a drag produced by a flow velocity of ink that flows into the individual flow passages from the ink supply chamber, whereby the bubble moves away from the ink inflow orifices.

2. The inkjet recording head cartridge according to claim 1, wherein at a given printing rate the following two expressions are satisfied:

$$[(Q/S)^2 \times Cd \times \rho \times \pi \times d^2]/8 < (\rho \times g \times \pi \times d^3)/6;$$

and $$d \geqq 2Np$$

where Q is an average ink flow quantity during printing, S is a minimum cross-sectional area in an ink flow direction within the ink supply chamber, Cd is a resistance coefficient, ρ is an ink density, g is a gravitational constant, Np is an individual flow passage (ink emission orifice) pitch, and d is a bubble diameter.

3. The inkjet recording head cartridge according to claim 1, wherein an ink tank chamber is provided that communicates with the ink supply chamber and supplies ink to the ink supply chamber.

4. The inkjet recording head cartridge according to claim 3, wherein a filter is located between the ink supply chamber and the ink tank chamber.

5. The inkjet recording head cartridge according to claim 3, wherein the ink tank chamber is located upward with respect to the ink supply chamber and holds ink.

6. The inkjet recording head cartridge according to claim 5, wherein an air lump of 1 $mm^3$ more always exists in the ink tank chamber.

7. The inkjet recording head cartridge according to claim 5, wherein the shipped recording head cartridge is ink filled without bubbles existing in the ink supply chamber.

8. The inkjet recording head cartridge according to claim 5, wherein the sum capacity of ink in the ink supply chamber and of ink in the ink tank chamber is greater than the total volume of ink emitted during one print job, defined as an ink temperature rise and cooling cycle in the recording head cartridge.

9. An inkjet recording apparatus comprising the inkjet recording head cartridge of claim 1.

10. An inkjet recording head cartridge comprising:

an ink emission face on which ink emission orifices are formed;

an ink supplier provided with an ink supplying chamber inside thereof; and a heater face orthogonal to the ink emission face, the heater face being part of a side surface of the ink supply chamber, wherein the ink supply chamber is formed so as to have a cross-sectional area allocated in an ink flow direction so that pressure fluctuation within the ink supply chamber at the time of ink emission becomes overattenuated or critically attenuated.

11. An inkjet recording apparatus comprising the inkjet recording head cartridge of claim 10.

12. An inkjet recording head cartridge comprising:

an ink emission face on which ink emission orifices are formed;

an ink supplier provided with an ink supplying chamber inside thereof; and a heater face orthogonal to the ink emission face, the heater face being part of a side surface of the ink supply chamber, wherein a relation of $(R1+R2)^2\times(C1+C2)\geqq 4\times(L1+L2)$ is satisfied, where L1 is an inertance of an individual flow passages, L2 is an inertance of the ink supply chamber, R1 is a resistance value of the individual flow passages, R2 is a resistance value of the ink supply chamber, C1 is a meniscus capacitance of the ink emission orifices, and C2 is an ink supply chamber capacitance.

13. An inkjet recording apparatus comprising the inkjet recording head cartridge of claim 12.

14. An inkjet recording apparatus, comprising:

individual flow passages each having an ink emission orifice at one end thereof and an ink inflow orifice at another end;

an ink supply chamber having open ink inflow orifices;

an ink tank chamber that supplies ink to the ink supply chamber through a filter member placed upward in a gravity direction of the ink supply chamber;

a determination unit that determines whether in one print job, defined as a temperature rise and cooling cycle of ink in the recording head cartridge, the total volume of ink emitted from the ink emission orifices exceeds the sum of the capacity of the ink supply chamber and the initial capacity of ink held in the ink tank chamber; and a printing control unit that, if the total volume of the ink emitted exceeds the sum of the capacity, halts printing during the print job and resumes printing after the ink within the ink supply chamber is cooled to a predetermined temperature.

* * * * *